US007389807B2

(12) United States Patent
Nagare et al.

(10) Patent No.: US 7,389,807 B2
(45) Date of Patent: Jun. 24, 2008

(54) SHEET SHUTTER DEVICE

(75) Inventors: Toyohide Nagare, Tokyo (JP); Hideki Tanemura, Tokyo (JP); Atsushi Matsumura, Tokyo (JP); Masahito Goto, Tokyo (JP); Takashi Nagata, Tokyo (JP); Katsuhiro Sakamoto, Tokyo (JP)

(73) Assignee: Sanwa Shutter Corporation, Tokyo (JP)

( * ) Notice: Subject to any disclaimer, the term of this patent is extended or adjusted under 35 U.S.C. 154(b) by 313 days.

(21) Appl. No.: 10/528,574

(22) PCT Filed: Jun. 30, 2004

(86) PCT No.: PCT/JP2004/009579

§ 371 (c)(1),
(2), (4) Date: Mar. 21, 2005

(87) PCT Pub. No.: WO2005/014965

PCT Pub. Date: Feb. 17, 2005

(65) Prior Publication Data

US 2006/0144530 A1 Jul. 6, 2006

(30) Foreign Application Priority Data

Aug. 12, 2003 (JP) ..... 2003-292343
Aug. 12, 2003 (JP) ..... 2003-292344

(51) Int. Cl.
*A47G 5/02* (2006.01)

(52) U.S. Cl. ..... 160/273.1; 160/268.1

(58) Field of Classification Search ..... 160/273.1, 160/272, 274, 267.1, 266, 268.1
See application file for complete search history.

(56) References Cited

U.S. PATENT DOCUMENTS

| | | | | |
|---|---|---|---|---|
| 4,884,617 | A * | 12/1989 | Coenraets | 160/271 |
| 5,219,015 | A * | 6/1993 | Kraeutler | 160/271 |
| 5,526,865 | A * | 6/1996 | Coenraets | 160/272 |
| 5,829,504 | A * | 11/1998 | Ekstrand et al. | 160/201 |
| 6,273,175 | B1 * | 8/2001 | Kellogg et al. | 160/205 |
| 6,698,490 | B2 * | 3/2004 | Hoerner et al. | 160/194 |
| 6,722,416 | B2 * | 4/2004 | Varley et al. | 160/264 |

FOREIGN PATENT DOCUMENTS

| | | |
|---|---|---|
| JP | B2 2884103 | 2/1999 |
| JP | A 2000-160961 | 6/2000 |
| JP | A 2001-12174 | 1/2001 |
| JP | A 2001-207756 | 8/2001 |

* cited by examiner

*Primary Examiner*—Blair M. Johnson
(74) *Attorney, Agent, or Firm*—Oliff & Berridge, PLC

(57) ABSTRACT

When a fitting piece slips out of a rail groove of a guide rail in connection with an excessive load on a shutter curtain is restored to the rail groove, the restoration is reliably set and noiselessly carried out. A posture holding bar and fitting pieces, which are spaced from both right and left sides of the posture holding bar at a predetermined interval, are provided at the lower end portion of the shutter curtain. A first guide body guides the posture holding bar to the opposing site to the rail groove in the process of an opening/closing operation of the shutter curtain. A second guide body guides the fitting piece at the lower end portion of the shutter curtain to the opposing side to the rail groove in conformity with a timing at which the posture holding bar is positionally regulated to the opposing side to the rail groove by the first guide body is provided at the upper side of the rail groove constituting the guide rail.

20 Claims, 23 Drawing Sheets

(A)

(B)

(A)

(B)

(C)

SHEET SHUTTER DEVICE

This application is a National Stage of PCT/JP2004/009579, filed Jun. 30, 2004, which claims priority from JP2003-292343 and JP2003-292344, both of which were filed Aug. 12, 2003, the disclosures of which are incorporated herein in their entireties by reference thereto.

TECHNICAL FIELD

The disclosure belongs to the technical field of a sheet shutter device having a flexible shutter curtain provided at an opening portion of an architectural structure or the like.

DESCRIPTION OF RELATED ART

There is generally known such a type of sheet shutter device wherein engaging pieces are secured to both side portions of a sheet-shaped shutter curtain so as to be spaced at a predetermined distance in the opening/closing direction, and the engaging pieces are engagingly fitted in rail grooves of guide rails at both side portions of the opening portion so as not to be detachable from the rail grooves and are made to run within the rail grooves, thereby opening/closing the opening portion. In this type of sheet shutter device, because the shutter curtain is formed of a sheet member having flexibility, the shutter curtain is greatly deformed when a large wind blast or a load from an obstruction is applied thereto, so that the guide rail or shutter curtain may be damaged.

As a countermeasure to this problem, there is known a sheet shutter device having such a structure that rail grooves of guide rails are designed to be flexible and the engaging pieces are disengaged from the rail grooves in such a case that a load in excess of a predetermined load is applied to the shutter curtain. The structure described above requires returning the temporarily-disengaged engaging pieces to the rail grooves again. The reengagement is not only cumbersome and troublesome, but also requires working overhead. Therefore, there has been proposed such a type that the engaging pieces are automatically restored to a state where they are engagedly fitted in the rail grooves. As one such type of shutter device there is known a shutter device wherein bone members which are harder than the sheet material of a shutter curtain and retain the posture of the shutter curtain at a plurality of places in the opening/closing direction are disposed integrally with a sheet-shaped shutter curtain having flexibility in the width direction, engaging pieces which are engagedly fitted in rail grooves are provided at both end portions of the bone members, auxiliary guides intercommunicating with the rail grooves from the outside of the rail grooves are formed integrally at the open-side end portions of the flexible rail grooves, and the engaging pieces are automatically engagedly fitted in the rail grooves via the auxiliary guides in the process of closing the shutter curtain in which the engaging pieces slip out of the guide rails (Japanese Published Patent No. 2884103).

SUMMARY OF THE DISCLOSURE

In the conventional shutter device, the end portions of the bone members as well as the engaging pieces are engagedly fitted in the rail grooves and thus the opening/closing sound is intense, the rail grooves are liable to be worn because the end portions of the bone members are in frictional contact with the rail grooves. Also the magnitude of the load, when the fitting pieces slip out of the rail grooves, varies with the passage of time. Furthermore, when the fitting pieces coming out of the rail grooves are automatically restored into the rail grooves, a plurality of bone-member end portions continuously and strongly abut against the auxiliary guides, so that the abutting sound is intensified and thus ambient noise occurs.

The disclosure addresses the foregoing situation to solve the above problems. In a sheet shutter device in which fitting pieces are provided at both side portions of a sheet-shaped shutter curtain so as to be spaced from one another at a predetermined distance in a vertical direction and made to run while engagedly fitted in rail grooves of guide rails provided at both side portions of an opening portion, thereby opening/closing the opening portion, the rail grooves are designed so that the fitting pieces come off from the rail grooves under an excessive load imposed on the shutter curtain, a posture holding bar is provided to at least the lower end portion of the shutter curtain so as to be spaced from the fitting pieces in the curtain width direction, and at the upper side of each of the rail grooves a first guide body is provided for guiding the posture holding bar to an opposing part to each of the rail grooves and a second guide body for guiding the fitting piece at the lower end portion of the shutter curtain to an opposing part to each of the rail grooves in conformity with a timing at which the posture holding bar is guided to the opposing part to the rail groove by the first guide body are provided at the upper side of each of the rail grooves.

With this structure, the fitting piece coming off out of the rail groove can be set to a restored state under which it is engagedly fitted in the rail groove, in the process of the opening/closing operation of the shutter curtain. However, the posture holding bar is prevented from abutting against the rail groove and also the fitting piece is reliably guided.

Further, a second guide body is formed to be longer in the vertical direction than the predetermined distance of the fitting pieces. With this structure, the guidance of the fitting piece toward the rail groove can be further reliably carried out.

A third guide body for guiding the fitting pieces toward each of the rail grooves is provided between the upper end portion of the rail groove and the first guide body. With this structure, the opening/closing operation of the shutter curtain can be smoothly performed.

The third guide body is provided with a freely deformable piece which can be deformed in front and rear directions corresponding to a direction perpendicular to the curtain face. With this structure, when the fitting piece, slipping out of the rail groove, is displaced to the second guide body side, the third guide body is prevented from getting in the way.

The first guide body has a pair of guide faces for guiding the posture holding bar to the opposing position to the rail groove, and guideways which are inclined-shaped and guide the posture holding bar to the guide face are formed on the guide face at the upper and lower sides. With this structure, the guidance of the posture holding bar to the guide face can be smoothly and reliably performed.

The freely deformable piece of the third guide body is formed so as to be located in a gap between the guideways that are opposite one another at the lower side of the first guide body. With this structure, the opening/closing operation can be smoothly performed, and the fitting piece coming off from the rail groove can be reliably restored to the original state.

The first and second guide bodies are integrally formed with each other. Thus, the number of parts can be reduced, and the structure can be simplified.

A step face for regulating the position in the right-and-left direction of the posture holding bar is formed between the guide face of the first guide body and a fitting piece guide portion which is formed in the second guide body and guides the fitting pieces toward the rail groove. With this structure, the position regulation of the posture holding bar in the right-and-left direction can be performed.

A curtain guide face for guiding both right and left side edge portions of the shutter curtain is formed in the fitting piece guide portion of the second guide body. With this structure, further posture correction of the shutter curtain can be performed.

The guide rail comprises a support rail fixed to each of both sides of the opening portion, a rail body which is engaged with the fitting pieces and supported so as to be freely displaced to the inside of the opening portion with respect to the support rail, and urging means for urging outwardly the rail body displaced to the inside of the opening portion in connection with a load imposed on the shutter curtain, the urging means comprises an elongated elastic member disposed along the outer surface of the support rail, an elongated receiving plate member applied to the outer surface of the elastic member and a joint member provided between the rail body and the receiving plate member so as not to come off, and an elastic deforming force of the elastic member acts on the rail body via the receiving plate member. With this structure, a large urging force can be secured without increasing the space of the guide rail, the use range of the sheet shutter device can be enlarged, and also the degree of freedom of adjusting the urging force can be improved.

When the fitting piece comes off from the rail groove, the operation of restoring the fitting piece to the original state can be smoothly and noiselessly performed and also the restoration of the fitting piece to the original state can be reliably performed.

The restoration of the fitting piece to the original state is further reliably performed, and the reliability of the sheet shutter device can be enhanced and the opening/closing operation of the shutter curtain can be smoothly performed.

The restoration of the fitting piece coming off from the rail groove to the original state can be reliably performed although the device carries out a smooth opening/closing operation.

The guidance of the posture holding bar to the guide face can be smoothly and reliably performed, the restoration of the fitting piece coming off from the rail groove to the original state can be reliably performed although the device carries out a smooth opening/closing operation, the positional regulation of the posture holding bar in the right-and-left direction can be performed, and posture correction of the shutter curtain can be performed.

The urging force can be strengthened without increasing the space of the guide rail. Therefore, the user range of the sheet shutter device can be enlarged, and also the degree of freedom of adjusting the urging force can be improved.

With all this, the number of parts can be reduced, and the structure can be simplified.

BRIEF DESCRIPTION OF THE DRAWINGS

The detailed description will reference the drawings in which.

DETAILED DESCRIPTION

Figure 1:
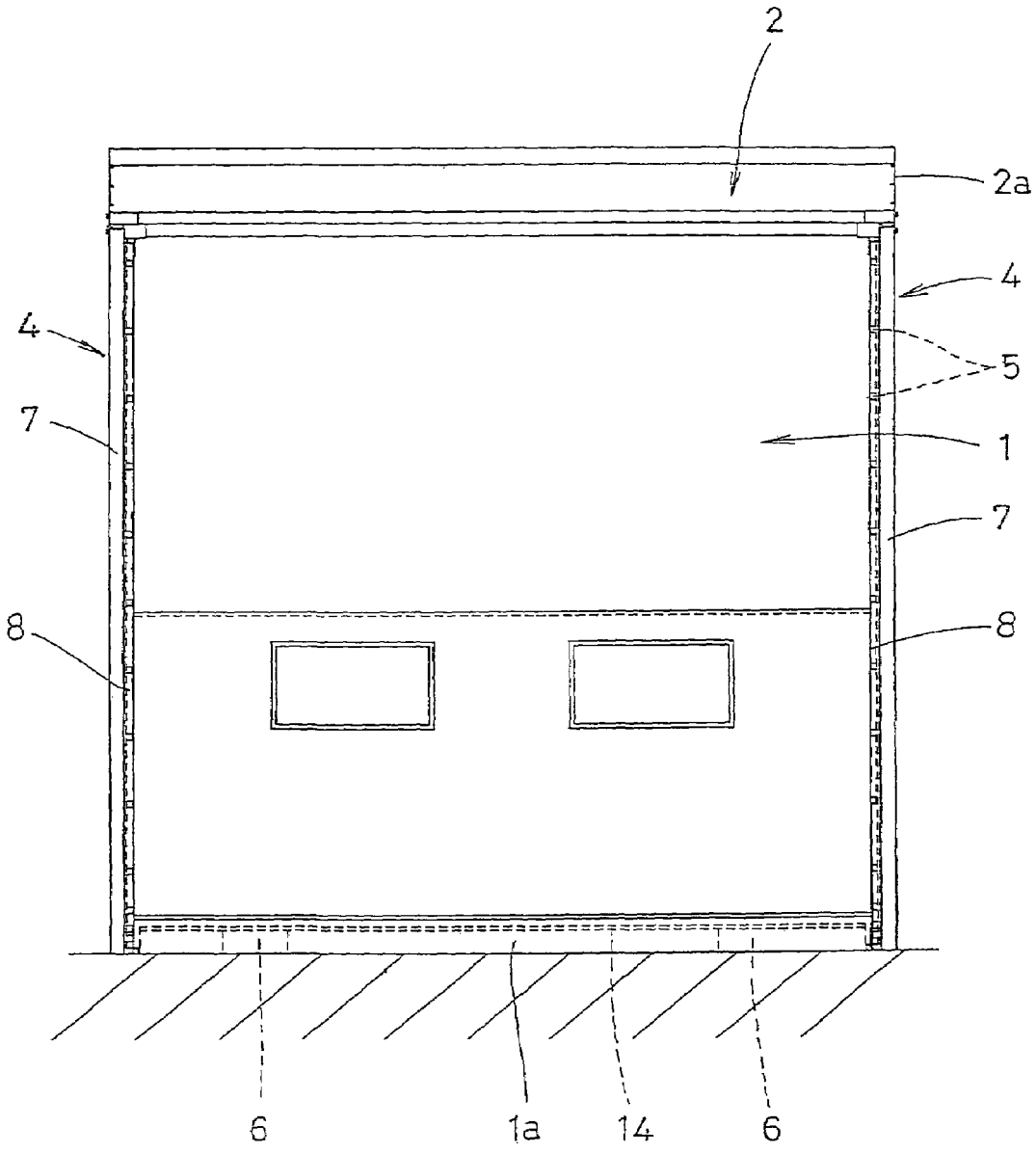
FIG. 1 is a front view schematically showing the structure of a sheet shutter device.
Figure 2:
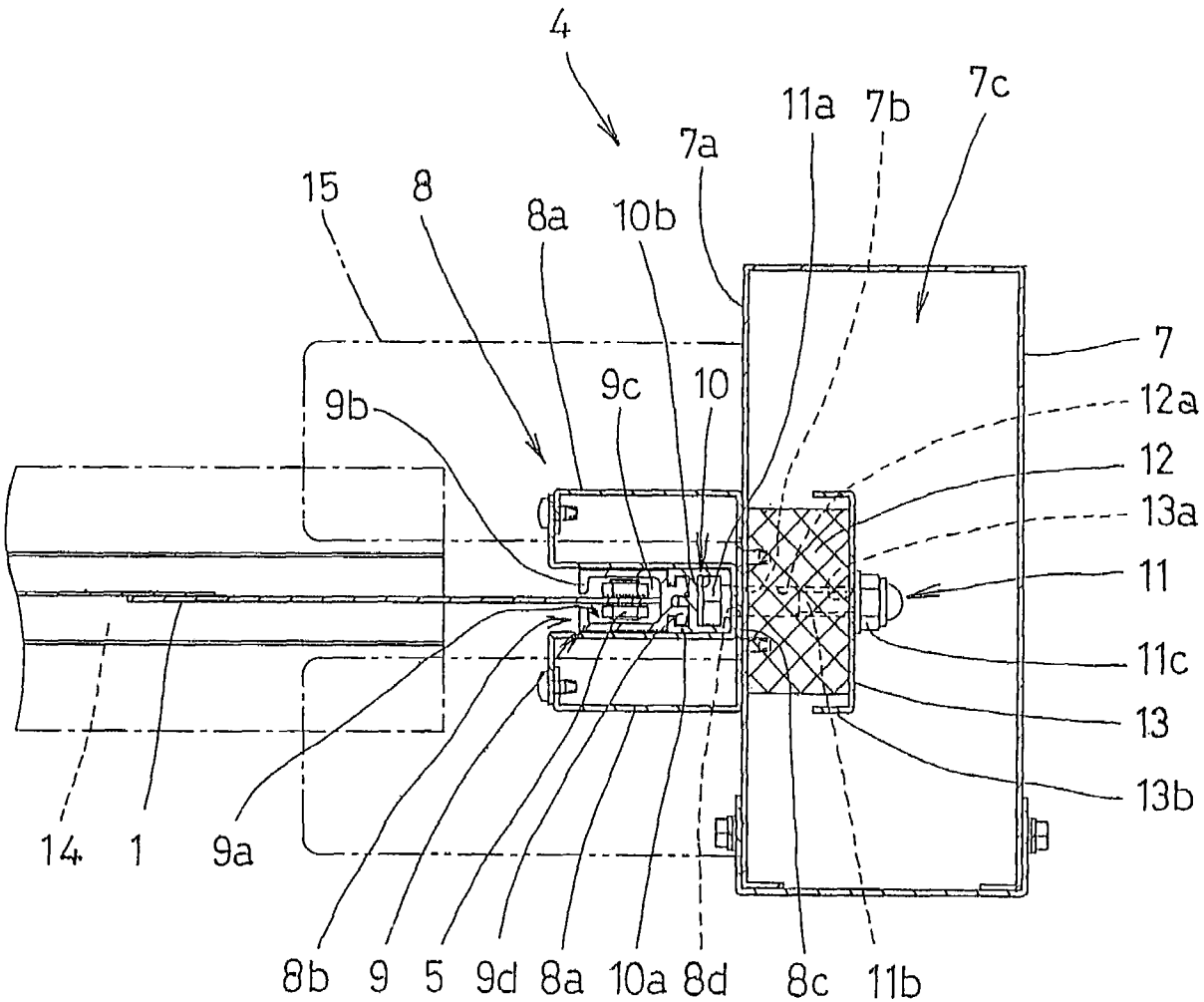
FIG. 2 is a planar cross-sectional view of the guide rail portion under a normal use state.
Figure 3:
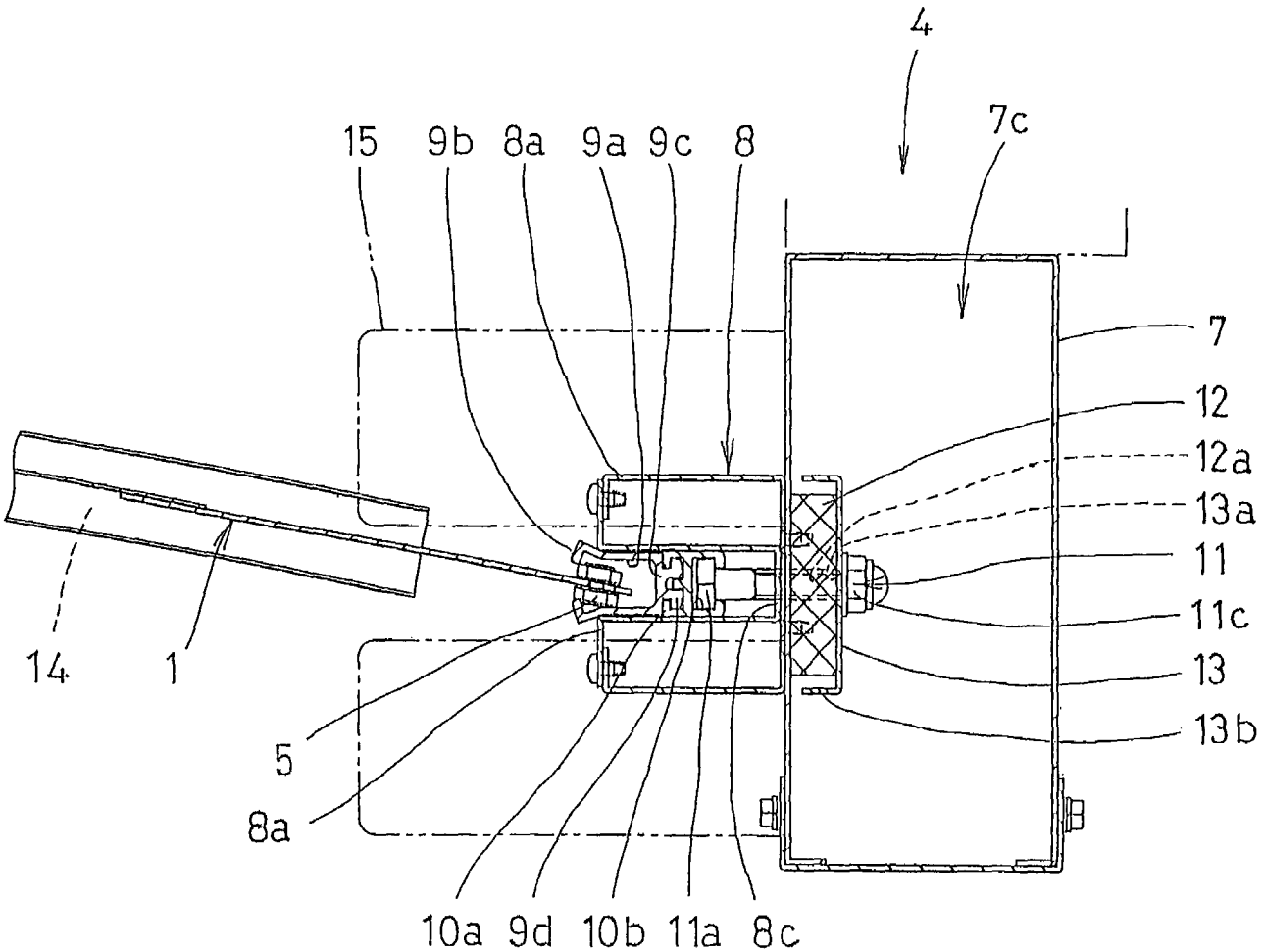
FIG. 3 is a planar cross-sectional view showing the guide rail portion to explain a state where a rail body is pulled.
Figure 4:
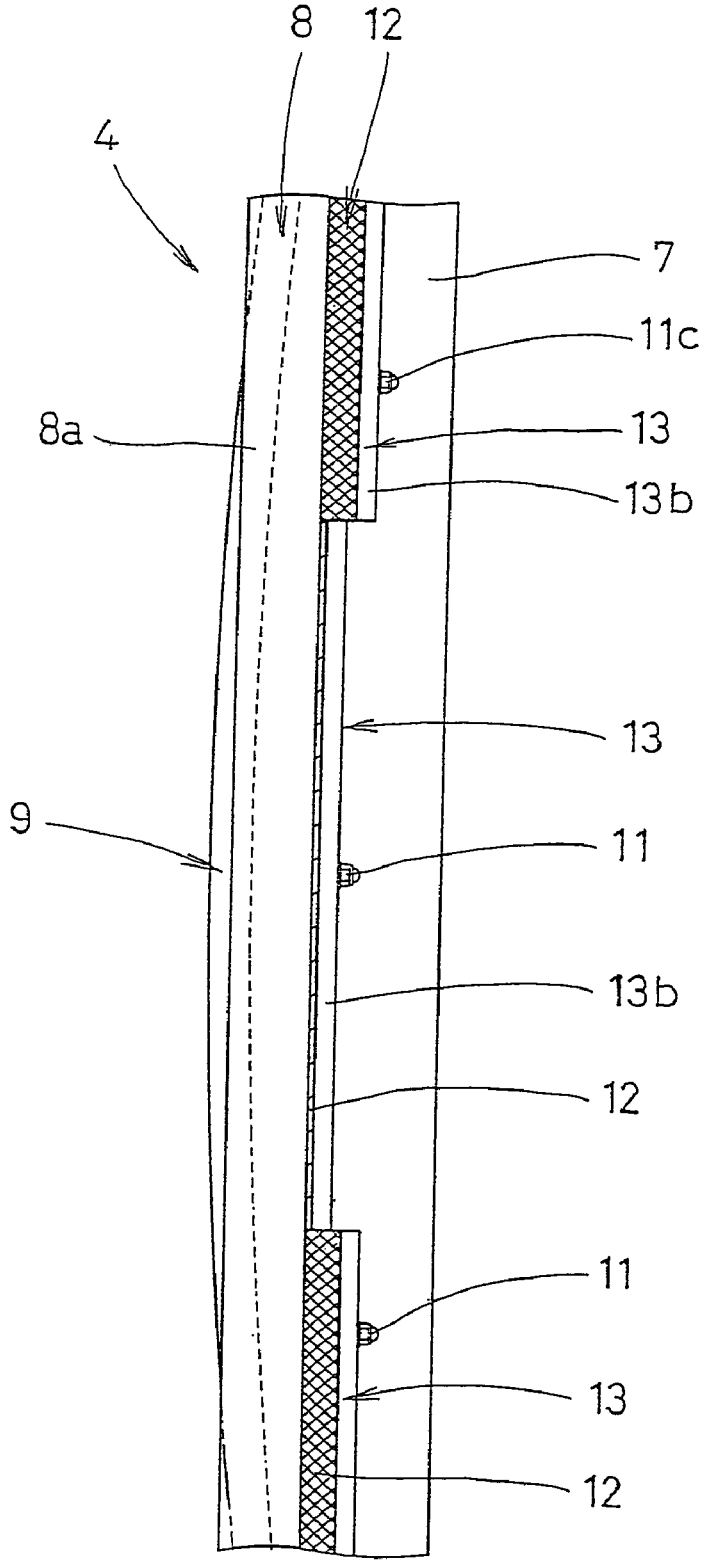
FIG. 4 is a side view showing the guide rail portion to explain a state where a part of the rail body is pulled.
Figure 5:
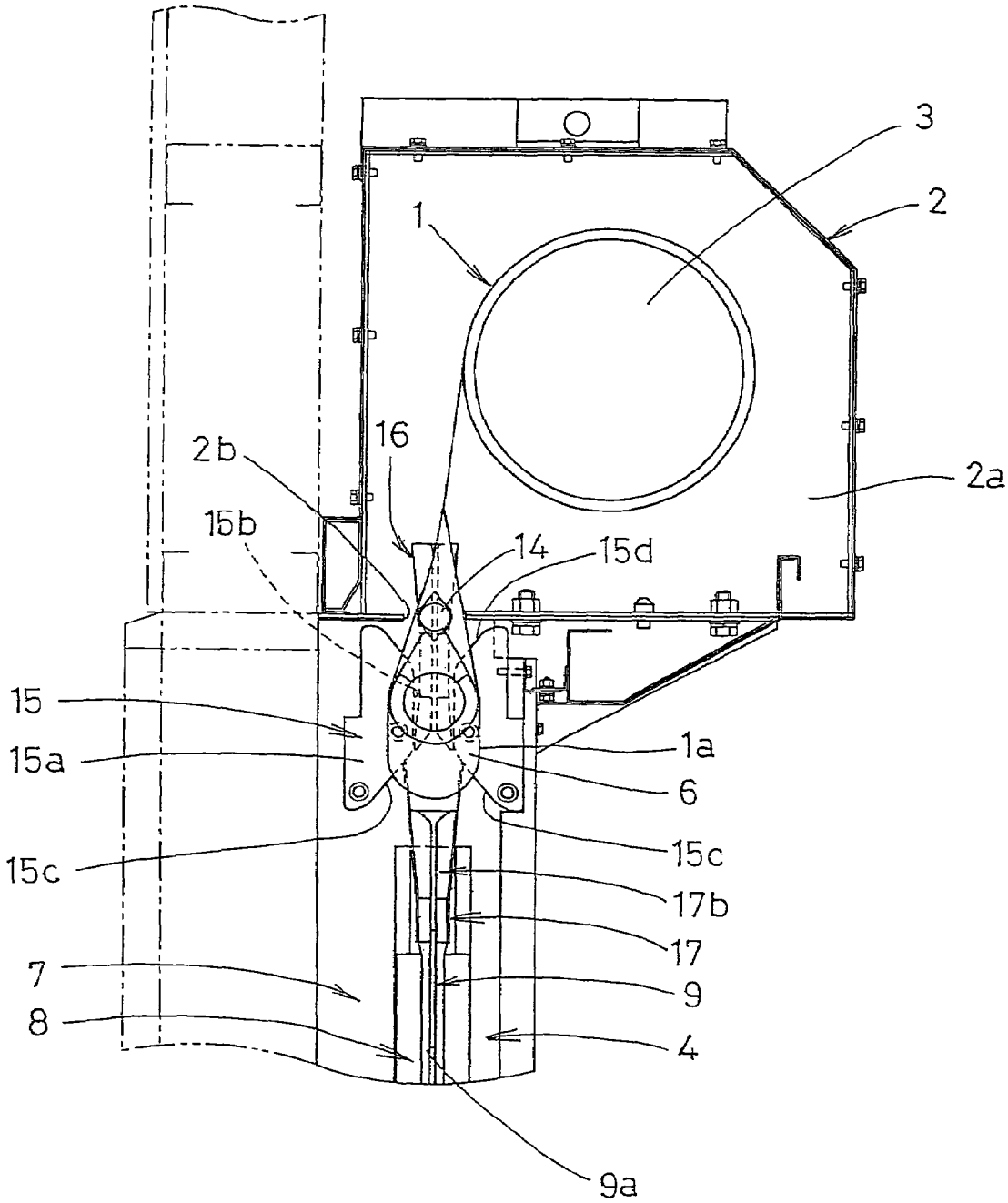
FIG. 5 is a side view of an upper end portion of the guide rail.
Figure 6:
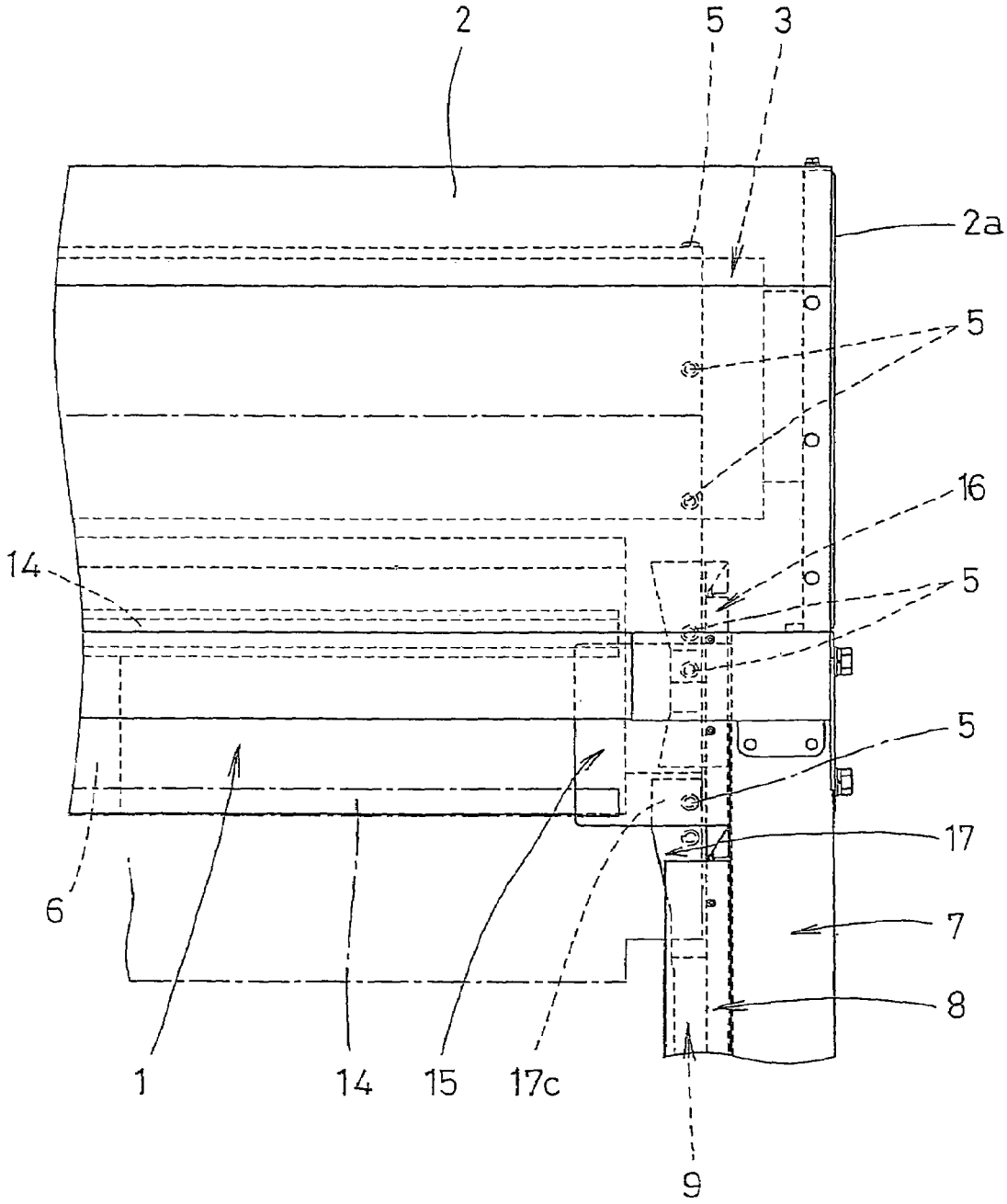
FIG. 6 is a front view of the upper end portion of the guide rail.

A first exemplary embodiment is described with reference to FIGS. 1-9(B).

A shutter curtain 1, of the sheet shutter device for opening/closing the opening portion of an architectural structure, is formed of a flexible sheet material. The shutter curtain 1 is wound around the outer periphery (outside) of a winding drum (take-up drum) 3 (FIG. 5) which is rotatably supported via a shaft on the right and left side plates 2*a* of a shutter case 2 disposed at a ceiling portion of a structure frame (at the curtain opening side of the structure frame). The shutter curtain 1 is wound off from or taken up to the winding drum 3 in connection with forward/reverse rotation of the winding drum 3 based on an opening/closing operation of an opening/closing unit (not shown), thereby opening/closing the opening portion. At this time, both right and left side edge portions of the shutter curtain 1 are vertically moved while guided by a pair of guide rails 4, a guide rail 4 provided at each side of the opening portion in the opening width direction (right-and-left direction).

Shutter curtain 1 is integrally provided with fitting pieces 5 at the right and left side edge portions thereof, which are spaced from one another at a predetermined interval in the vertical direction. The fitting pieces 5 (FIGS. 2, 6, 8 and 9) are set to be movably fitted in the rail grooves 9*a* of the guide rail 4, which will be described later, so as to be prevented from slipping out of the rail grooves. The lower end edge portion of the shutter curtain 1 is designed in a bag-shaped portion 1*a* by folding the sheet material of the shutter curtain 1, and a pair of right and left bottom weights 6 are installed in both end portions in the right-and-left direction of the bag-shaped portion 1*a*. Accordingly, the bottom weights 6 act as poises at the lower end portion of the shutter curtain 1, so that the shutter curtain 1 can be smoothly operated during the closing operation of the shutter curtain 1 and the impact can be absorbed when it abuts against an obstruction.

The guide rails 4 provided at both side portions of the opening portion are equipped with hollow metal fixing brackets 7 which are integrally fixed to both right and left sides of the opening portion of the structure frame in the vertical direction.

A support rail 8 (FIG. 2) is provided with a pair of front and rear (indoor and outdoor) support piece portions 8*a* which are spaced from each other at a predetermined interval and are integrally fixed to one side piece 7*a* of each fixing bracket 7 at the opening portion side. Each support rail 8 is formed by bending a metal plate material, and a recess groove portion 8*b* is formed in the gap between the opposing sides of the pair of support piece portions 8*a*, and the bottom piece portion 8*c* of the recess groove portion 8*b* and the side surfaces of the support piece portions 8*a* which are located on the same plane as the bottom piece portion 8*c* are pressed against the one side piece 7*a* of each fixing bracket 7 and fixed to the fixing bracket 7 by a screw.

A rail body 9, which is elongated in the vertical direction, is attached to the recess groove portion 8*b* of each support rail 8 so as to be freely movable in the right-and-left direction. The rail body 9 is integrally molded using a flexible resin material, and designed so as to be opened at the opening portion side and have a rail groove 9*a* in which fitting pieces 5 equipped to the shutter curtain 1 are engagedly fitted. Come-off-preventing pieces 9*b* for preventing coming out of the fitting pieces 5 from the rail grooves 9*a* are formed at the opening portion of the rail grooves 9*a*. Under the state that the rail body 9 is located in each support rail recess groove portion 8*b* and deformation of each rail groove 9*a* is regulated by the support piece portion 8*a*, the come-off-preventing piece 9*b* prevents the fitting pieces 5 from coming off from, or out of, the rail groove 9*a*. On the other hand, as described later, when the fitting pieces 5 pull the rail body 9 inward to the opening portion and thus slide from the support rail recess groove portion 8*b* by a predetermined displacement amount, so that the fitting pieces 5 come outside the support rail recess groove portion 8*b*, the regulation of the deformation of the rail groove 9*a* by the support piece portion 8*a* is lost, and thus the rail groove 9*a* is deformed, so that the fitting pieces 5 come off, or out of, from the rail groove 9*a*.

An elongated auxiliary rail 10 is disposed between the rail body 9 and the support rail bottom piece portion 8*c*. An engaged piece 10*a* projects towards the opening portion side of the auxiliary rail 10 and is engaged with an engaging piece 9*d* which is formed at the groove bottom portion 9*c* of the rail body rail grove 9*a* so as to project toward the structure frame side, whereby the rail body 9 and the auxiliary rail 10 are set to work integrally with each other with respect to the movement in the right-and-left directions. A recess portion 10*b* opened at the structure frame side is formed in the auxiliary rail 10, and a bolt head 11*a* of a long bolt 11, corresponding to a joint member, is engaged with the recess portion 10*b* so as to prevent coming off. A plurality of long bolts 11 are engaged with the auxiliary rail 10 so as to be spaced from one another at a predetermined interval in the rail longitudinal direction (vertical direction). Shaft portions 11*b* of the long bolts 11, which project to the structure frame side, penetrate through holes 8*d*, 7*b* formed so that the support rail bottom piece portion 8*c* and the fixing bracket side piece 7*a* intercommunicate with each other via the through holes, and extend to the inside of the hollow portion 7*c* of the fixing metal bracket 7.

Further, an elastically deformable buffer member 12 is provided over the entire length in the longitudinal direction along the outer surface of the one side piece 7*a* (the outer surface of the opening portion) in the hollow portion 7*c* of the fixing bracket 7. The buffer member 12 is cut into a plurality of parts in the vertical direction in accordance with the number of the long bolts 11, and each long bolt shaft portion 11*b* is set to penetrate through hole 12*a* formed at the center portion of each buffer member 12. Here, any member may be used as the buffer member 12 insofar as it is elastically deformable (restorable deformation) and also can be equipped over the whole length along the one side piece 7*a*. For example, it may be structured by forming a high-density resin material in an elongated rectangular shape. In this embodiment, a hard sponge is adopted.

A receiving plate member 13 which is formed in accordance with the vertical length of the buffer member 12 is allocated to the outer surface of each buffer member 12, and the long bolt shaft portion 11*b* projecting from the buffer-member through hole 12*a* penetrates a through hole 13*a* formed in the receiving plate member 13 so that each nut is screwed together at one end portion of the through hole 13*a*. Accordingly, the long bolt 11 is set so as to be prevented from coming off over the area extending from the rail body 7 to the receiving plate member 13.

Here, the nut 11*c* is designed to be threaded with the long bolt 111 until the nut 11*c* receives proper elastic force from the buffer member 12. Accordingly, the rail body 9 is urged toward an outside of the opening portion, and maintained in a normal guide position where it is located at the side of the bottom piece portion 8*c* of the support rail 8 via the auxiliary rail 10. The receiving plate 13 is formed of material having proper flexibility and, for example, is formed of spring material, metal material, such as steel or the like.

In the guide rail 4 thus structured, at the time of doing the opening/closing operation in connection with the wind-up or wind-out operation of the shutter curtain 1 or during a fully closing operation, when a load is imposed on the shutter curtain because wind is blown to the shutter curtain 1 or an obstruction abuts against the shutter curtain, the load thus imposed pulls the rail body 9 via the fitting pieces 5 toward the inside of the opening portion and the buffer member 12 receives the pulling force via the long bolts 11.

If the load imposed on the shutter curtain 1 is small and the sliding displacement amount of the rail body 9 caused by deformation of the buffer member 12 is within such a range that the support rail support piece portion 8*a* can prevent deformation of the rail groove 9*a*, the fitting pieces 5 are prevented from coming off from the rail groove 9*a*. When the load is large (excessive load state) and the buffer member 12 is greatly deformed so that the rail groove 9*a* is pulled such that the displacement amount exceeds the sliding displacement amount, the regulation of the deformation of the rail groove 9*a* by the support rail support piece portion 8*c* is lost, so that the rail groove 9*a* is deformed and the fitting pieces 5 come off from, or out of, the rail groove 9*a*.

The coming-off load is preset on the basis of the shape, such as the thickness, hardness, cross-sectional area, etc., of the buffer member 12 and further on the basis of the shape, such as the thickness, cross-sectional area, length, etc., of the receiving plate member 13, whereby the degree of freedom to adjust the coming-off load can be increased.

That is, in this embodiment, the buffer member 12 which receives some load in connection with pulling of the shutter curtain 1 is designed to be long in the rail longitudinal direction, and also the buffer member 12 is equipped with the receiving plate member 13. Accordingly, the long bolts 11, which are equipped so as to be spaced from one another in the rail longitudinal direction, receive elastic deforming force over the whole length of the buffer member 12 via the receiving plate member 13, urge the rail body 9 outward from the opening portion by the elastic deforming force thus received. Therefore, as described above, the urging force acting on the rail body 9 by the long bolts 11 corresponds to the elastic deforming force over the whole length of the elongated buffer member 12, and thus it can cope with the load imposed on the shutter curtain 1 while serving as a stronger urging force than when a coil spring is wound around a conventional long bolt 11 to apply a local urging force to the long bolt 11. Accordingly, the urging force can be magnified without increasing the space of the guide rail, and the use range of the sheet shutter can be enlarged.

In this shutter device, each receiving plate member 13 is formed of a flexible plate material, and designed so that flexibility occurs therein when it is pulled at a place where the corresponding long bolt 11 is disposed. Accordingly, the urging force acting on the rail body 9 is set to be the resultant force of the elastic deforming force of the buffer member 12 and the flexible force of the receiving plate member 13. Therefore, the coming-off preventing load of the fitting pieces 5 of this embodiment can be adjusted by the strength of the elastic deforming force of the buffer member 12 and the flexible force of the receiving plate member 13, and the coming-off preventing load of the fitting pieces 5 can be set on the basis of this strength, so that the degree of freedom of adjusting the urging force can be improved.

The adjustment based on the buffer member 12 is carried out by varying the hardness and thickness of the buffer member 12 or varying the length of the buffer member 12 with respect to the length of the long bolts 11, and the adjustment based on the receiving plate member 13 is carried out by varying the length thereof with respect to the buffer member 12 and the thickness of the plate member.

Reinforcing pieces 13*b* which are bent to the buffer member 12 side are integrally formed at both side edge portions of the receiving plate member 13 in the longitudinal direction to thereby enhance the strength of the flexibility of the receiving plate member 13. By varying the bent length of the reinforcing pieces, the flexible force of the receiving plate member 13 can be adjusted.

As described above, the bottom weights 6 are equipped at the lower end portion of the shutter curtain 1, and a posture holding bar 14 for holding the posture of the shutter curtain 1 is also provided at the lower end portion of the shutter curtain 1. The posture holding bar 14 is used to maintain the posture of the sheet-shaped shutter curtain 1 in the width direction. It is designed so as to extend to the outside area in the right-and-left direction (curtain width direction) of the area where the bottom weights 6 are disposed, and so that the length thereof is shorter in length than the width of the shutter curtain 1 and does not extend to both right and left end portions of the shutter curtain 1 at which the fitting pieces 5 are equipped. Accordingly, the posture holding bar 14 is prevented from being engaged with the rail grooves 9*a* of the guide rails 4. Furthermore, the fitting pieces 5 are provided at both right and left end portions of the shutter curtain 1 which correspond to right and left sides of the posture holding bar 14 so as to be spaced from the posture holding bar 14 at predetermined intervals.

A curtain entrance/exit portion 2*b* (FIG. 5) serving as an entrance/exit portion where the shutter curtain 1 winds on/off the winding drum 3 is formed at the lower side of the shutter case 2. First, second and third guide bodies 15, 16, 17 are provided between the end portion of the entrance/exit portion 2*b* and the upper end portions of the respective right or left guide rail 4 so that the opening/closing operation of the shutter curtain 1 can be smoothly carried out. Also, when the fitting pieces 5 come off, or apart, from the rail grooves 9*a*, the fitting pieces 5 can be engagedly fitted in the rail grooves in connection with the opening/closing operation of the shutter curtain 1, thereby restoring the fitting pieces 5 to the original state.

First, second and third guide bodies 15, 16, 17 (FIG. 9) are secured to corresponding places on each of the right and left sides. However, as a matter of convenience, only the first, second and third guide bodies 15, 16, 17, at the right side in FIG. 1, will be described, and description of the bodies at the left side is omitted from the following description.

That is, there is a space between the curtain entrance/exit port 2*b* and the upper end portion of the rail groove 9*a* of the pair of guide rails 4, and in the space the first guide body 15 is provided for guiding (positionally regulating) the posture holding bar 14, which is attached to the lowermost end of the shutter curtain 1, to base positions with respect to the rail groove 9*a*. The base positions are the positions where the end face of the posture holding bar 14 is parallel to the bottom face of the rail groove 9*a* (FIGS. 2 and 3) and are referred to as an opposing position to each of the rail grooves 9*a*. The first guide body 15 is formed of resin material having no flexibility (resin material having flexibility may be used), and comprises a pair of guide pieces 15*a* for clamping the end portion of the posture holding bar 14 from the front and rear sides. Each guide piece 15*a* is fixed to one side piece 7*a* of the fixing bracket 7 so as to provide a predetermined opposing gap in the front-and-rear directions. Each guide piece 15*a* projects so as to be nearer to the opening portion side than the support rail 8 constituting the guide rail 4 and so that opposing faces are formed so as to face the end portions of the posture holding bar 14 from the front-and-rear directions. Opposing faces, located at an intermediate position in the vertical direction, are formed on the guide faces 15*b* so that the interval therebetween is slightly larger than the outer diameter of the posture holding bar 14. The opposing face of each guide piece 15*a* has a lower side guideway 15*c*, which is continuous to the lower end of the guide face 15*b* and inclined so that the opposing interval is increased toward the lower side, and an upper guideway 15*d*, which is continuous to the upper end of the guide face 15*b* and inclined so that the opposing interval is increased toward the upper side.

Figure 9:
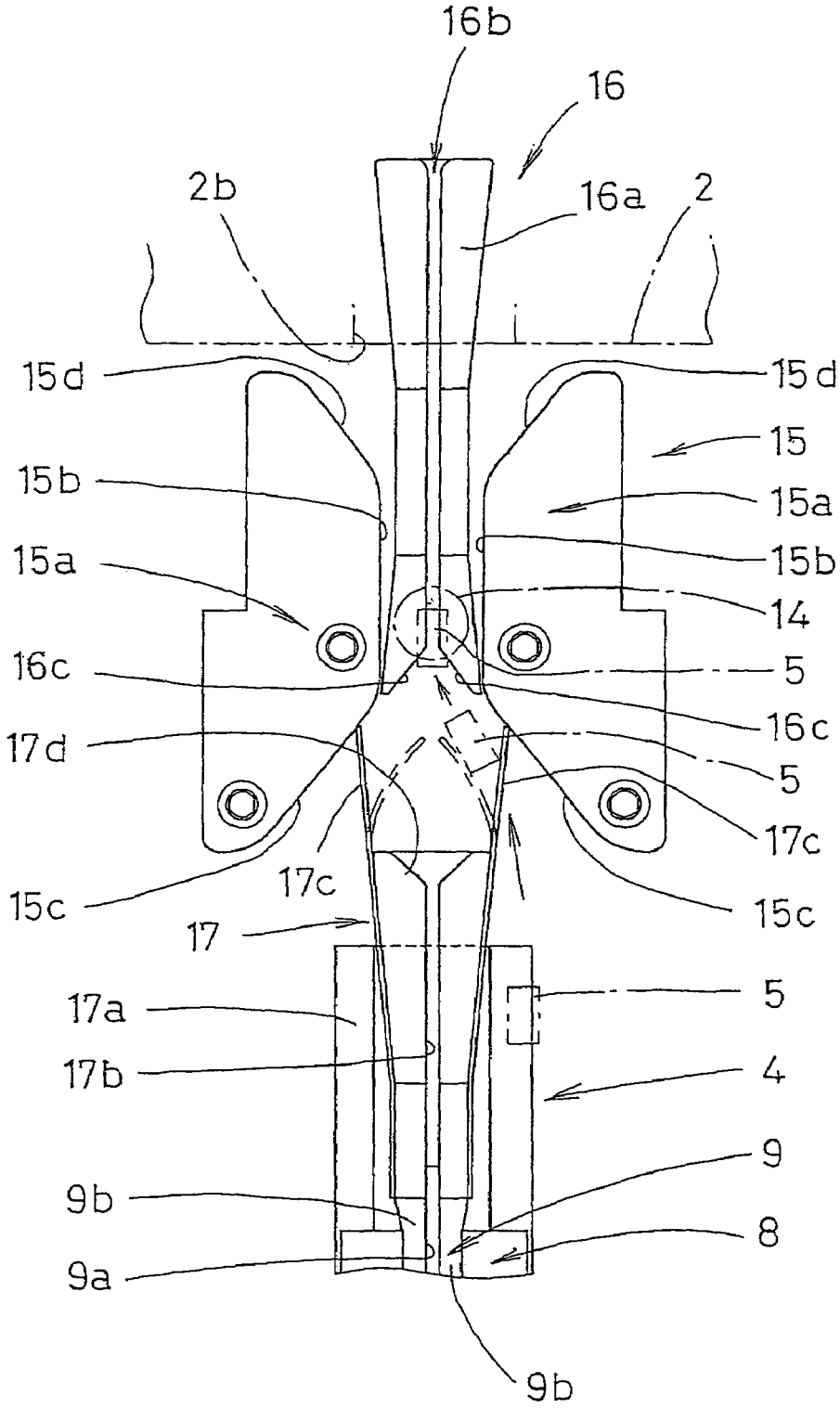
FIG. 9 is an enlarged side view of the main part.

The second and third guide bodies 16, 17 are arranged in the vertical direction between the opposing guide pieces 15*a* of the first guide body 15. The second guide body 16 is formed of resin material having flexibility as in the case of the rail body 9. The second guide body 16 has a guide groove 16*b* having the same coming-off preventing pieces 16*a* integrally formed in the vertical direction. The second guide body 16 is set to have such a vertical positional relationship that the lower end is substantially coincident with the lower end edges of the first guide body guide faces 15*b*, and the upper end thereof is provided so as to extend from the curtain entrance/exit portion 2*b* into the shutter case 2. The second guide body 16 is designed so that the groove width is increased at the upper and lower ends (i.e., the length is lengthened in the front-and-rear directions) or the right-and-left direction as seen in FIG. 9. Guide faces 16*c*, whose opposing gap is reduced at the upper side thereof, are formed at the lower end of the coming-off preventing pieces 16*a*.

Figure 7:
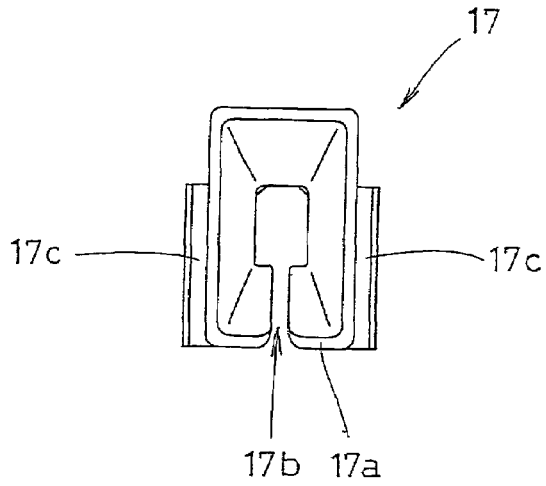
FIGS. 7(A), 7(B) and 7(C) are a plan view, side view and front view of a third guide body, respectively.
Figure 7:
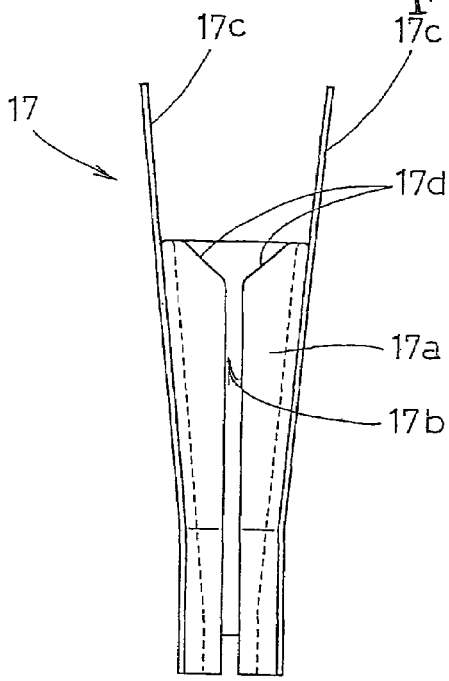
Figure 7:
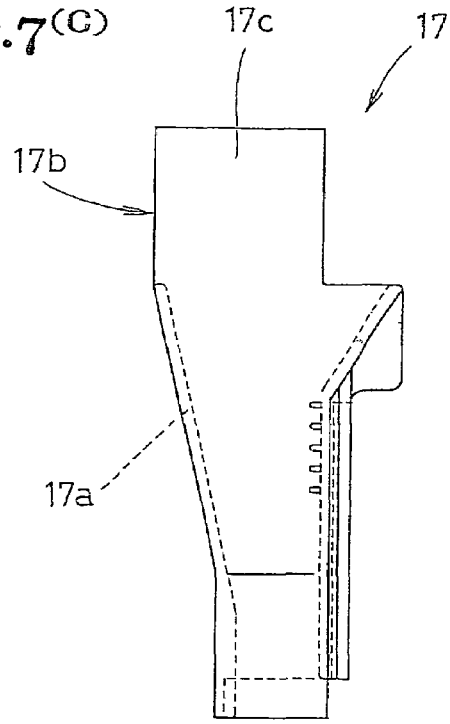
Figure 8:
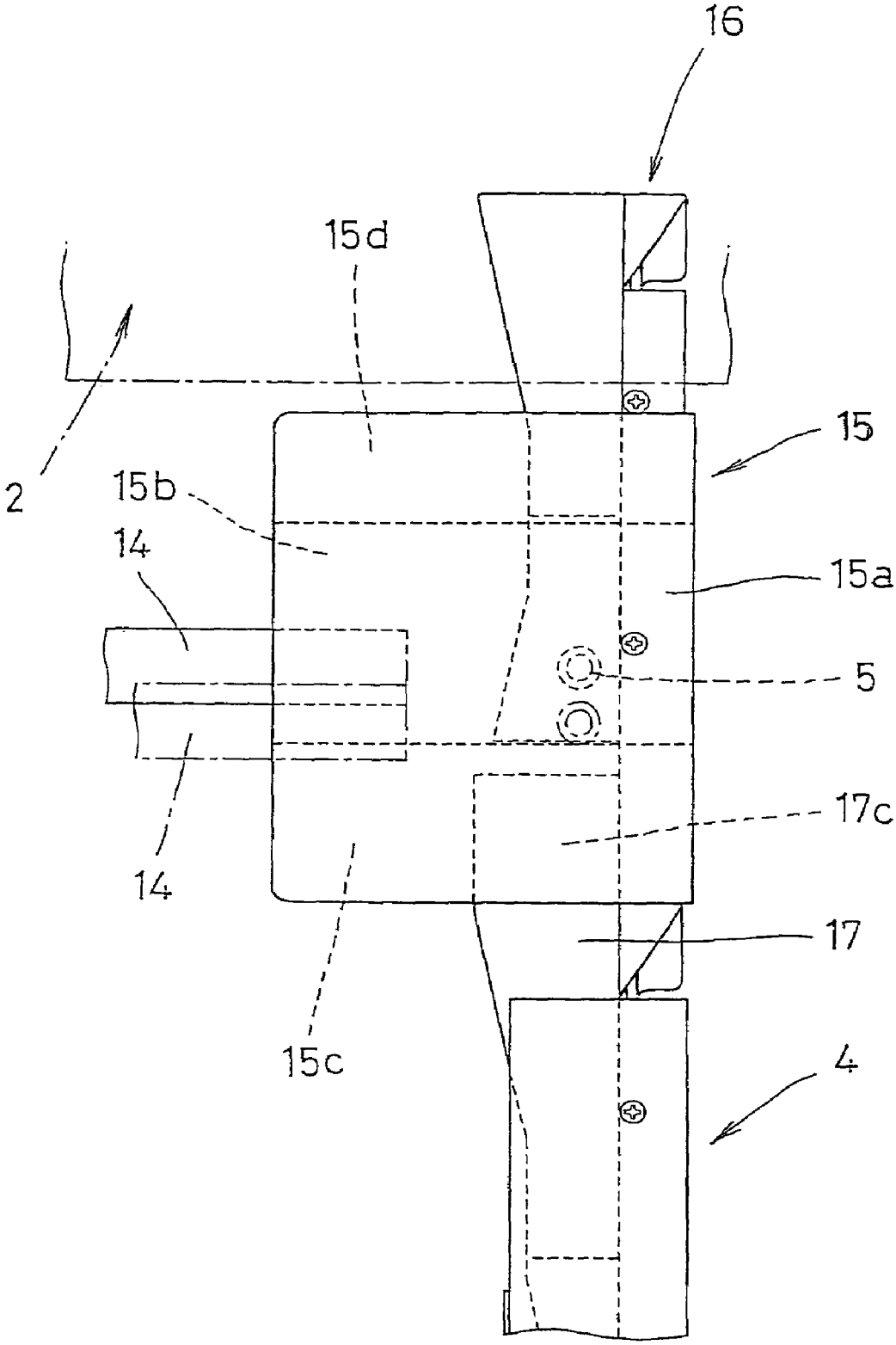
FIG. 8 is an enlarged front view of the main part.

The third guide body 17 (FIGS. 7(A)-7(*c*)) is formed of flexible resin material as in the case of the second guide body 16 and rail body 9. A guide groove 17*b* having an coming-off preventing piece 17*a* like the rail groove 9*a* is integrally formed in the vertical direction. The third guide body 17 is disposed in such a vertical positional relationship that the upper end edge is substantially coincident with the lower end edge of the first guide body 15 (FIG. 5), and the lower end edge is integrally joined so as to be fitted over the upper end portion of the rail groove 9*a* while the third guide groove 17*b* and the rail groove 9*a* intercommunicate with each other. Furthermore, freely-deformable pieces 17*c* are formed at the upper end edge of the third guide body 17 so as to extend from the front-and-rear side pieces. The freely-deformable pieces 17*c* are more flexible than the third guide body 17, and are displaced in a front-and-rear direction that is perpendicular to the curtain face, by a pressing force of the fitting pieces 5 described later. The freely-deformable pieces 17*c* are located in the opposing gap between the lower side guideways 15*c* of the first guide body so that the upper end edges thereof extend to the lower side guideways 15*c* and oppose the lower end portions of the second guide body 16 in proximity to the lower end portions. The third guide body 17 is designed so that the groove width is increased and also the length thereof in the right-and-left direction is gradually lengthened proceeding to the upper end, and guideways 17*d* whose gap is increased to the upper side thereof are formed at the upper end edges of the coming-off preventing pieces 17*a*.

When an excessive load acts on the shutter curtain 1 located at the opening portion and the fitting pieces 5 located at the intermediate portion in the vertical direction of the shutter curtain come off from the guide groove 9*a* of the guide rail 4 while the fitting pieces 5 located at the right and left side portions of the posture holding bar 14 do not come off from the guide groove 9*a*, the shutter curtain 1 at the positions corresponding to the fitting pieces 5 that have come off is freely wound around the winding drum 3 by carrying out an opening operation of the shutter curtain 1. At this time, because the posture holding bar 14 and the fitting pieces 5 located at the right and left sides thereof do not come off from the guide rails 4 they are displaced to the winding drum 3 side via the first guide body 15 or the second and third guide bodies 16, 17.

On the other hand, when the posture holding bar 14 and the fitting pieces 5 located at the right and left side portions thereof come off from the guide rails 4, the fitting pieces 5 which are located at higher positions than the posture holding bar 14 and come off from the guide rails 4 are freely wound up around the winding drum 3 by opening the shutter curtain 1 as described above, and thus the fitting pieces 5 are not necessarily required to be engagedly fitted in the second guide groove 16*c*.

When the posture holding bar 14 that has come off from the guide rail 4 is moved upwardly, the posture holding bar 14 abuts against any one of the front and rear lower side guideways 15*c* of the first guide body 15 and is guided to the guide face 15*b* side. Here, the maximum opposing gap (groove width) between the lower-side guideways 15*c* of the first guide body 15 is set from the maximum displacement amount of the posture holding bar 14 based on the shutter curtain 1 amount fed from the case entrance/exit portion 2*b*, and the posture holding bar 14 interferes with the lower side guideways 15*c* under the state that the fitting pieces 5 of the lower end portion come off from the guide rail 4. At this time, the fitting pieces 5 which are located at the lower end portion and at the right and left side portions of the posture holding bar 14 are located in the vicinity of the upper portion of the third guide body 17. Therefore, the posture holding bar 14 is displaced to the guide face 15*b* side while guided by the lower side guideways 15*c*, and in connection with this displacement of the posture holding bar 14, the fitting pieces 5 press the freely deformable pieces 17*c* as indicated by an virtual line of FIG. 9, and guides the fitting pieces 5 to the second guide groove 16*c* side while deforming the freely deformable pieces 17*c*. The fitting pieces 5 of the lower end portion reach the lower side of the second guide groove 16*c* in conformity with the timing at which the posture holding bar 14 reaches the guide faces 15*b* and is guided so as to regulate the position in the front-and-rear directions (posture correction) (see the virtual line of FIG. 6).

That is, the posture holding bar 14 carries out the positional regulation in the right-and-left direction of the shutter curtain 1 (holding the posture), and also it is guided (positionally regulated) in the front-and-rear directions by the first guide body 15, whereby the fitting pieces 5 which are located at the right and left sides of the posture holding bar 14 and also at the lower end portion of the shutter curtain 1 are positioned to the lower end portion of the second guide grove 16*c* while guided in the front-and-rear directions and the right-and-left direction. Therefore, under this posture state, the shutter curtain 1 is further opened, whereby the fitting pieces 5 of the lower end portion are reliably engagedly fitted in the second guide groove 16*b* and, thus, the guidance to the opposing site to the rail groove 9*c* can be reliably carried out. Here, the second guide body 16 is designed so that the groove width is increased to the lower end portion and the guideways 16*c* are formed at the lower end portions of the slipping out pieces 16*a*. Therefore, the fitting pieces 5 are guided to the second guide groove 16*b* and thus the engagement of the fitting pieces 5 can be reliably carried out.

As described above, the fitting pieces 5 which are located at the lower end portion of the shutter curtain 1 and also at the sides of the posture holding bar 14 are engagedly fitted in the guide groove 16*b* of the second guide body 16 at the full open time of the shutter curtain 1 even when the fitting pieces 5 come off from the rail groove 9*a* at the opening portion. Accordingly, at least at the lower end portion of the shutter curtain 1, the fitting pieces 5 are restored to the state that they are engagedly fitted in the rail groove 9*a*.

When the closing operation is carried out on the shutter curtain 1 from the full-open state, at least the fitting pieces 5 which are located at the lower end portion and also at both sides of the posture holding bar 14 are engagedly fitted in the second guide grooves 16*b* and thus restored to the original posture. Therefore, when the closing operation is carried out on the shutter curtain 1, the shutter curtain 1 is downwardly moved in conformity with the posture of the lower end portion. Therefore, with respect to even the intermediate portion of the shutter curtain 1 taken up around the winding drum 3 while the fitting pieces 5 come off from the second guide groove 16*b*, the posture of the intermediate portion is restored while displaced between the winding drum 3 and the second guide body 16, and the fitting pieces 5 are engagedly fitted in the second guide groove 16*b* and guided to the opposing base position with respect to the rail groove 9*a*, namely toward the rail groove 9*a*, whereby all the fitting pieces 5 located at the opening portion are engagedly fitted in the rail groove 9*a* by setting the shutter curtain 1 to the fully closed posture. Here, the length in the vertical direction of the second guide body 16 is set to be longer than the arrangement distance of the fitting pieces 5 provided to the shutter curtain 1. Therefore, under the state that a precedent fitting piece 5 is engagedly fitted in the second guide groove 16*b* and guided toward the rail groove 9*a*, the following fitting piece 5 is engagedly fitted in the second guide groove 16*b*, whereby all the subsequent fitting pieces 5 are engagedly fitted in the second guide groove 16*b*.

In the closing operation of the shutter curtain 1, the posture holding bar 14 is guided and moved to the guide faces 15*b* by the upper guide faces 15*d* of the first guide body 15, and the fitting pieces 5 fed from the winding drum 3 side pass from the upper end portion of the second guide body 16 having a large groove width via the second guide groove 16*b* and the third guide groove 17*b* of the third guide body 17 having a larger groove width to the rail groove 9*a*, whereby the fitting pieces 5 which are positionally regulated to the base positions with respect to the rail groove 9*a* by downwardly moving the second guide body 16 are reliably guided to the rail groove 9*a* side to close the opening portion.

In the first embodiment thus structured, the winding drum 3 is forwardly/reversely rotated by driving the opening/closing mechanism (not shown), and in connection with this rotation, the shutter curtain 1 carries out the opening/closing operation while the fitting pieces 5 at both side portions are engagedly fitted in the guide rails 4 and guided under the state that the coming-off is prevented. In this case, the rail body 9 constituting the guide rail 4 is designed to be freely movable in the right-and-left direction with respect to the support rail 8, and also the rail body 9 is designed to come off from the recess groove portion 8*a* of the support rail 8 when an excessive load acts on the shutter curtain 1. Accordingly, the shutter curtain 1 and the guide rails 4 are protected. Furthermore, the fitting pieces 5 are provided at the lower end portion of the shutter curtain 1 and the posture holding bar 14 is provided with the gap from the fitting pieces 5, and also the first, second and third guide bodies 15, 16, 17 are provided at the upper portion of the guide rails 4. When a fitting piece 5 comes off from the rail groove 9*a* of the guide rail 4, the fitting piece 5 at the lowermost end at which the posture holding bar 14 is provided is subjected to the posture holding in the right-and-left direction by the posture holding bar 14, and also the posture holding bar 14 is guided by the guide face 15*b* of the first guide body 15 in the process of the opening operation of the shutter curtain 1, thereby carrying out the positioning in the front-and-rear directions. Accordingly, the fitting pieces 5 which are located at the lower end portion and at both sides of the posture holding bar 14 are positioned in the right-and-left direction and in the front and rear direction, and forcedly positioned toward the rail grooves 9*a*, whereby the fitting pieces 5 are allowed to be restored to the rail grooves 9*a*. In this case, the posture holding bar 14 is designed so as not to be engagedly fitted in the rail grooves 9*a*. Therefore, the posture holding bar 14 does not interfere with the rail grooves 9*a* in the process of the opening/closing operation of the shutter curtain 1, the rail grooves 9*a* are prevented from being worn away, and thus the opening/closing operation can be carried out noiselessly. In addition, the posture holding bar 14 is provided so as to oppose at least the fitting pieces 5 at the lower end portion, whereby the fitting pieces 5 are guided toward the rail grooves 9*a* and under this state all the fitting pieces 5 are engagedly fitted in the rail grooves 9*a* by closing the shutter curtain 1, thereby restoring the fitting pieces to the original state. The restoring operation can be carried out noiselessly because the posture holding bar 14 does not interfere with the rail grooves 9*a*.

In addition, the fitting pieces 5 are engagedly fitted in the second guide grooves 16*b* provided at the opposing sites of the rail grooves 9*a* in conformity with the timing at which the posture holding bar 14 is guided in the front-and-rear directions by the first guide body 15, so that the engagedly fitting operation of the fitting pieces 5 to the second guide groove 16*b* can be reliably carried out, and the reliability of the restoration to the rail grooves 9*a* can be further enhanced.

Furthermore, because the length in the vertical direction of the second guide body 16 is longer than the arrangement distance of the fitting pieces 5 of the shutter curtain 1, the next fitting piece 5 is guided toward the second guide groove 16*b* side during the period when the fitting piece 5 at the lower end portion is being guided to the second guide groove 16*b* in the process of the closing operation of the shutter curtain 1. Therefore, guidance of the fitting pieces 5 to the second guide groove 16*b* is made reliable, so that the guidance of the fitting pieces 5 to the confronting site to the rail groove 9*a* can be further reliably carried out.

Still further, the third guide body 17 having the third guide groove 17*b* which closely intercommunicates with the second guide groove 16*b* is provided at the lower side of the second guide body 16, and the third guide groove 17*b* is provided so as to intercommunicate with the rail groove 9*a*. Therefore, the fitting piece 5 guided by the second guide groove 16*b* can reliably be guided via the third guide groove 17*b* to the rail groove 9*a*, thereby enhancing the reliability of the sheet shutter device.

In addition, the third guide body 17 is provided so as to be close to the second guide body 16 in the vertical direction, so that the guidance of the fitting pieces 5 toward the rail groove 9*a* can be reliably performed. The freely-deformable pieces 17*c* are provided to the upper portions of the front and rear side pieces of the third guide body 17, and when the fitting piece 5 comes off from the guide rail 4, the freely deformable piece 17*c* is deformed, and displaced to the second guide body 16 side, so that the engagement restoring operation of the fitting piece 5 to the guide rail 4 can be smoothly performed.

Furthermore, the first guide body 15 is provided with the guideways 15*c*, 15*d* for guiding the posture holding bar 14 to the guide face 15*b* side, and thus the guidance to the base position with respect to the rail groove 9*a* is smoothly performed.

With respect to the structure of the guide rail 4 of this embodiment, the long bolt 11 joined to the rail body 9 is applied to the outer surface of the one side piece 7*a* of the fixing bracket 7 for fixing the support rail 8, and receives the elastic deforming force of the overall elongated buffer member 12 provided over the entire length in the vertical direction via the receiving plate member 13 applied from the outside of the buffer member 12, so that the rail body 9 is urged to the outside of the opening portion by the elastic deforming force received via the receiving plate member 13. Therefore, as compared with the conventional guide rail structure where the coil elastic piece is wound around the long bolt to apply a local urging force to the shutter curtain, a larger urging force can be applied to the shutter curtain.

In the conventional guide rail structure, when the urging force of the coil elastic piece is strengthened to provide a large coming off load so that the fitting piece 5 can be prevented from coming off due to air pressure acting on the shutter curtain 1, the coming off load is locally larger at the coil elastic piece disposed site, and thus there is a disadvantage that a fitting piece hardly comes off when an obstruction abuts against a shutter curtain and thus a large load partially acts on the shutter device. On the other hand, with respect to the guide rail 4 of this embodiment, the load acting on the shutter curtain 1 is received by the entire buffer member 12 elongated in the vertical direction, so that the coming off load is not locally increased, and thus the above disadvantage can be overcome. As a result, the sheet shutter device of this embodiment can be disposed not only in a room which is only slightly affected by wind, but also outdoors. Therefore, the use range of the sheet shutter device can be enlarged.

Furthermore, when the coming off load of the fitting piece 5 from the rail groove 9*a* is adjusted on the basis of the adjustment of the urging force applied to the rail body 9 via the buffer member 12 and the receiving plate member 13 by the long bolt 11 in the guide rail 4, the coming off load can be adjusted not only by adjusting the thickness, and hardness, of the buffer member 12, but also by adjusting the length, and flexibility of the receiving plate member 13, so that the degree of freedom of adjusting the urging force can be greatly improved.

In addition, in this case, the elastic deforming force of the buffer member 12 over the entire length of the rail can be used as the urging force, and a large urging force can be secured. Therefore, a disadvantage, such as a large-size design, can be avoided, and the number of long bolts 11 used need not be increased, so that the cost can be reduced.

A leaf spring or the like which is formed like a waveform may be used as the buffer member 12, and it may be designed as an elongated body over the entire length of the guide rail.

The receiving plate member 13 may be provided with a plurality of elongated members which are disposed so as to be spaced from one another at predetermined intervals. Furthermore, the receiving plate member 13 may be formed of a flexible material, and it may be designed as an elongated member extending over the entire length of the guide rail.

Figure 10:
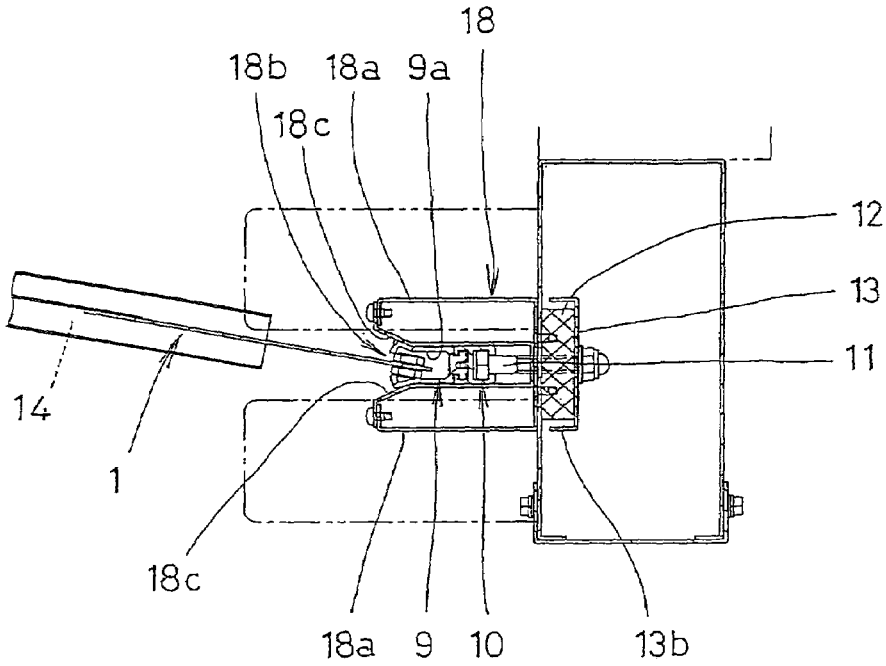
FIGS. 10(A) and 10(B) are planar cross-sectional views of a guide rail portion according to a second embodiment.
Figure 10:
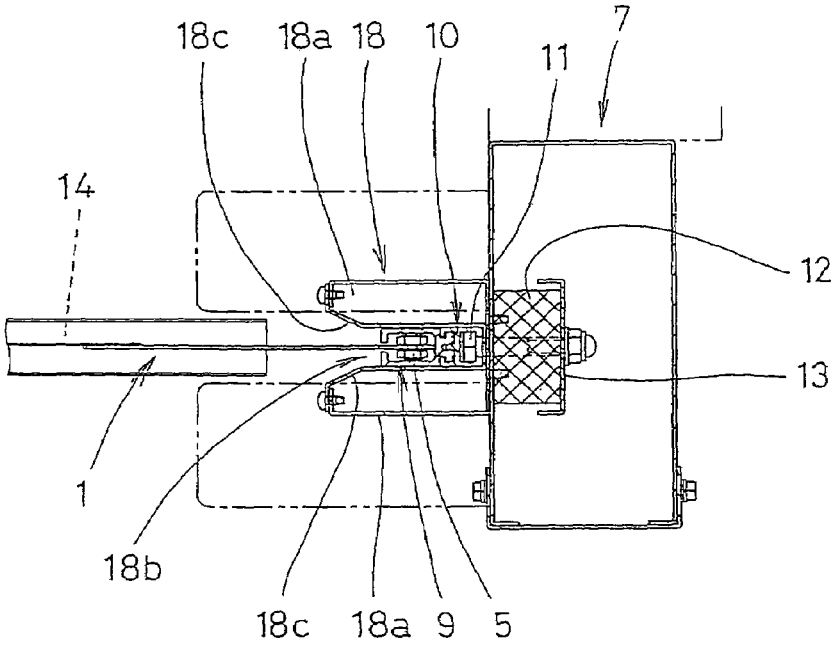
Figure 11:
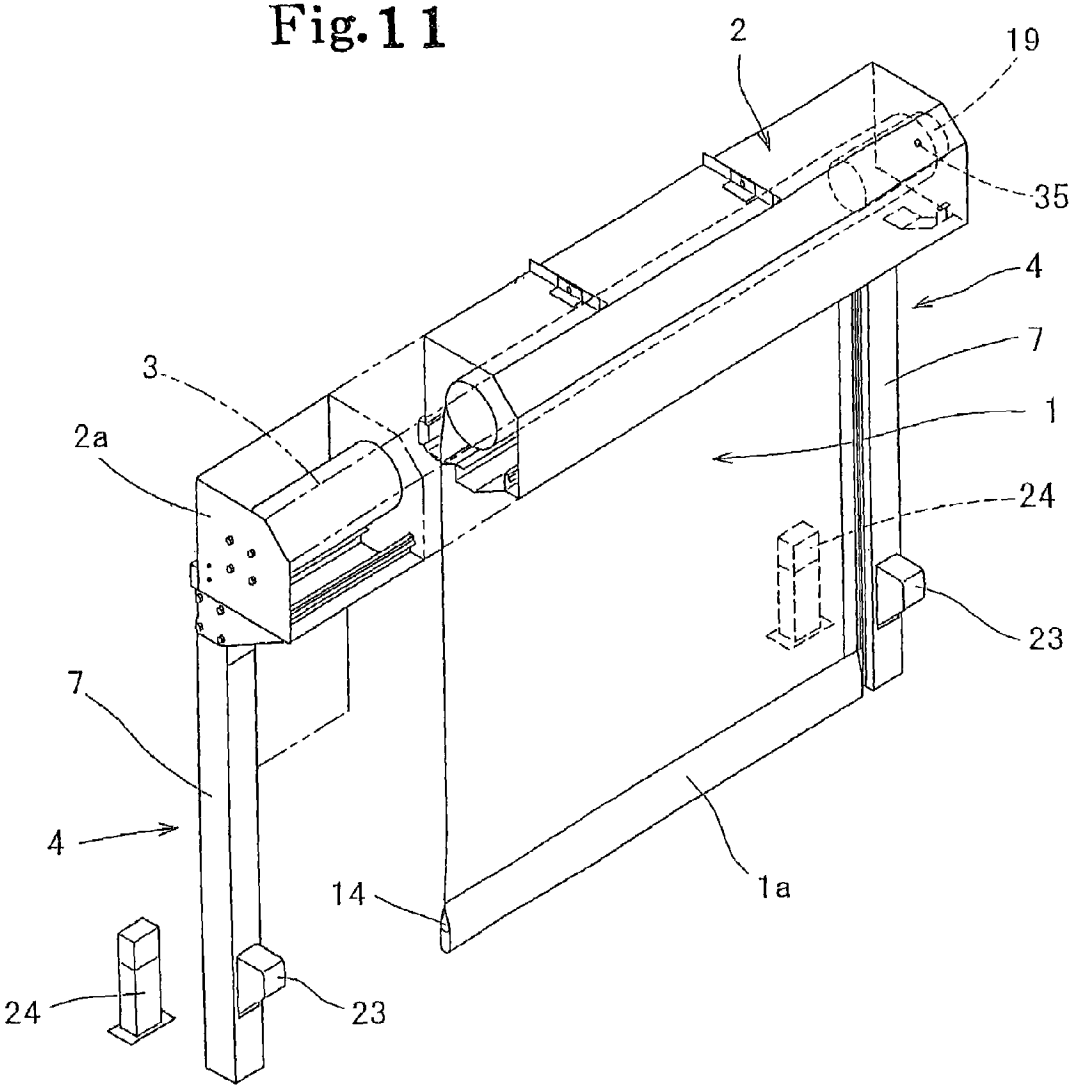
FIG. 11 is a perspective view showing a sheet shutter device according to a third embodiment.

Next, a second embodiment will be described with reference to FIG. 10. In this embodiment, guide faces 18*c* for guiding the rail body 9 to the coming off side are formed at the groove opening portion of the recess groove portion 18*b* of a support rail 18 which is structured by a pair of guide faces 18*c*. With this structure, when the support rail 18 is formed of metal and the rail body 9 is formed of resin material, the rail body 9 can be protected.

Subsequently, a third embodiment will be described with reference to FIGS. 11 to 16. The sheet shutter device of this embodiment has the same structure as the first embodiment. The same reference numerals as the first embodiment are applied, and description of the structure is omitted.

The sheet shutter device of this embodiment is designed so that it is maintained fully closed at all times, and it is automatically opened at a predetermined high speed when there is an object to pass through the opening and then automatically closed at a predetermined high speed, whereby the air conditioning atmosphere in the room can be maintained. Therefore, an electric-motor driven type opening/closing device 19 having an electric motor is interlockingly joined to the winding drum 3, and a controller 20 for controlling the rotational operation of the opening/closing device 19 is provided. The opening/closing device 19 of this embodiment is installed in the cylinder of the winding drum 3. Furthermore, first and second starting sensors 21, 22 are provided at the front and rear sides of the upper portion of the opening portion (entrance/exit portion), and also first and second detecting sensors 23, 24 are provided in the vicinity of the lower end portion of the shutter curtain 1 in the front-and-rear directions. These sensors 21, 22, 23, 24 (FIGS. 12 and 13) are connected to the controller 20 (FIG. 13). Each of the first and second starting sensors 21, 22 is structured by using an infrared switch, and detects a passing object (person, vehicle or the like) in the vicinity of the opening portion to output a detection signal to the controller 20. Each of the first and second detecting sensors 23, 24 is structured by a photoelectric switch having a light emitter and a photodetector, and it detects an object passing through or obstruction in the vicinity of the shutter curtain 1 to output a detection signal to the controller 20.

On the basis of input of a signal from any one of the first and second starting sensors 21, 22, the controller 20 outputs an opening operation command to the opening/closing device 19 so that the opening operation is carried out on the shutter curtain 1. After the shutter curtain 1 is opened, on the basis of the detection states of the first and second starting sensors 21, 22 and the first and second detecting sensors 23, 24, a closing operation command is output to the opening/closing device 19 after a proper time elapses so that the shutter curtain 1 is closed at a predetermined closing speed.

Next, an example of the procedure of the opening/closing control of the opening/closing device 19 by the controller 20 will be described. The sheet shutter device of this embodiment is designed to be in a fully-closed posture at all times. Therefore, when the system is started and initialized (FIG. 14), the shutter curtain 1 is set to the fully-closed posture and under this state, the controller 20 determines whether there is an input of the detection signal from either one or both of the first and second starting sensors 21, 22, that is, whether a passing object such as a person, a vehicle or the like is close to the sheet shutter device. If there is an input of the detection signal from at least one of the first and second starting sensors 21, 22, the opening control is carried out, and subsequently the closing control is carried out.

Figure 12:
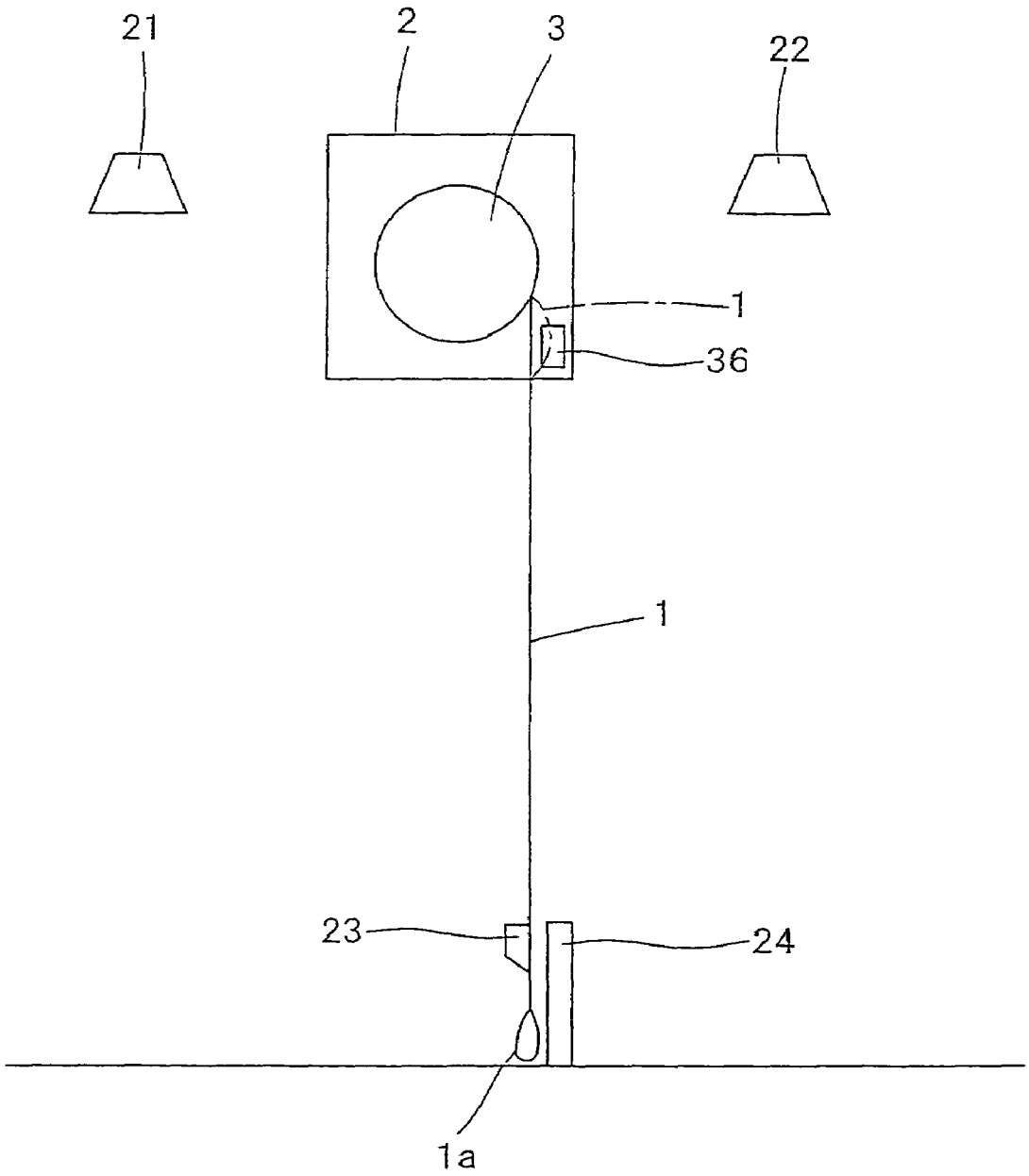
FIG. 12 is a side view showing an arrangement state of a sensor group of the third embodiment.
Figure 13:
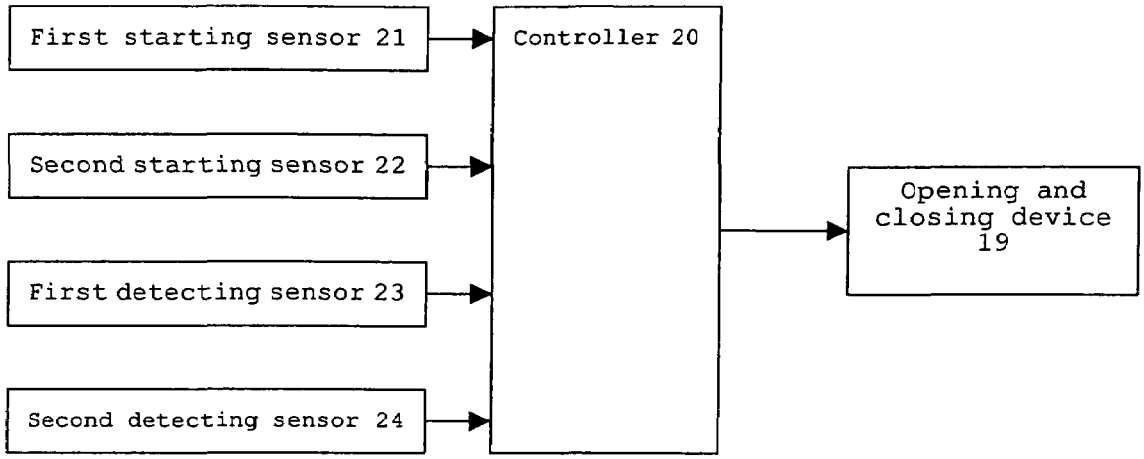
FIG. 13 is a block diagram showing the control state of a controller according to the third embodiment.
Figure 14:
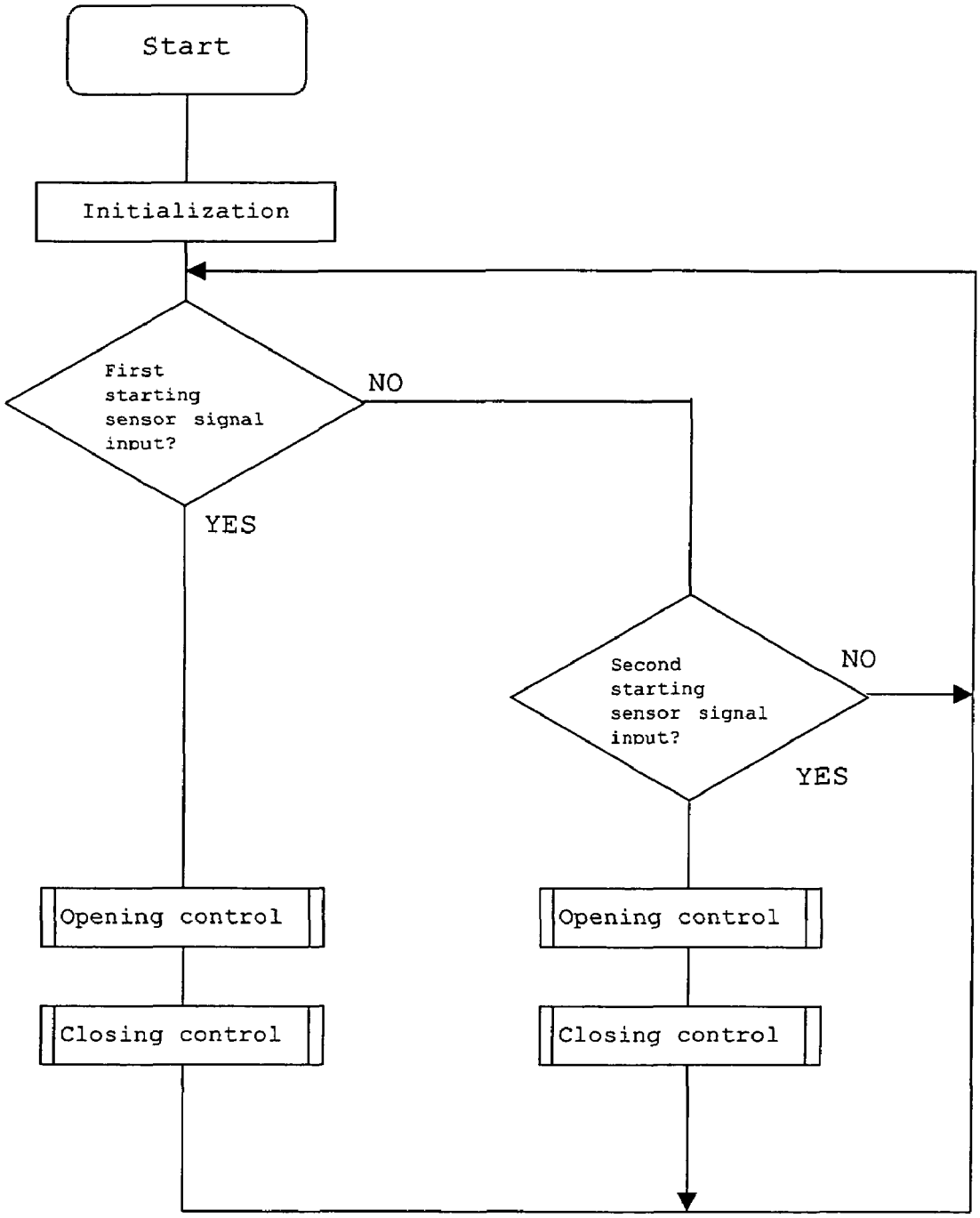
FIG. 14 is a flowchart showing an overview control procedure of the controller according to the third embodiment.
Figure 15:
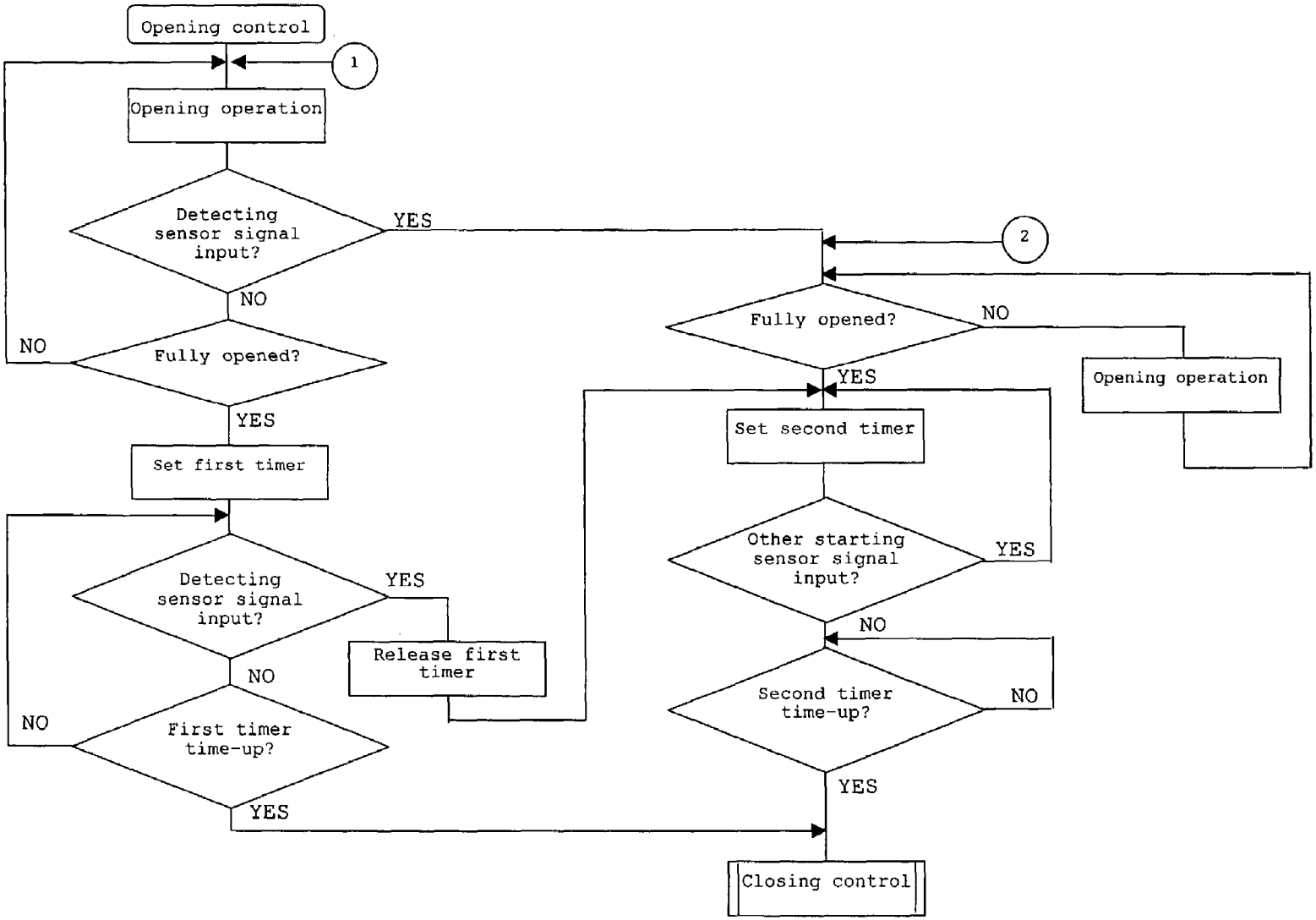
FIG. 15 is a flowchart showing opening control in the controller of the third embodiment.
Figure 16:
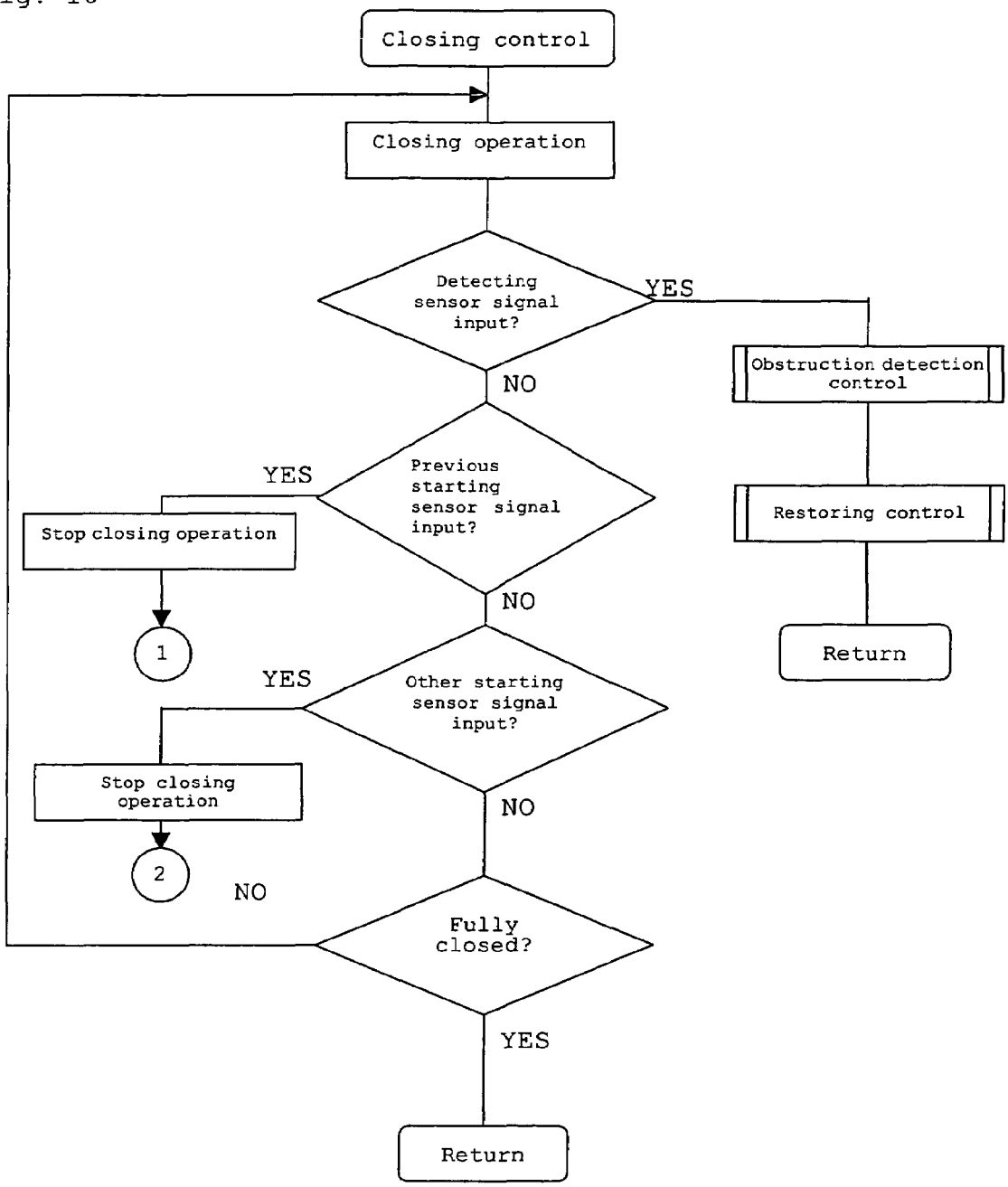
FIG. 16 is a flowchart showing closing control in the controller of the third embodiment.
Figure 17:
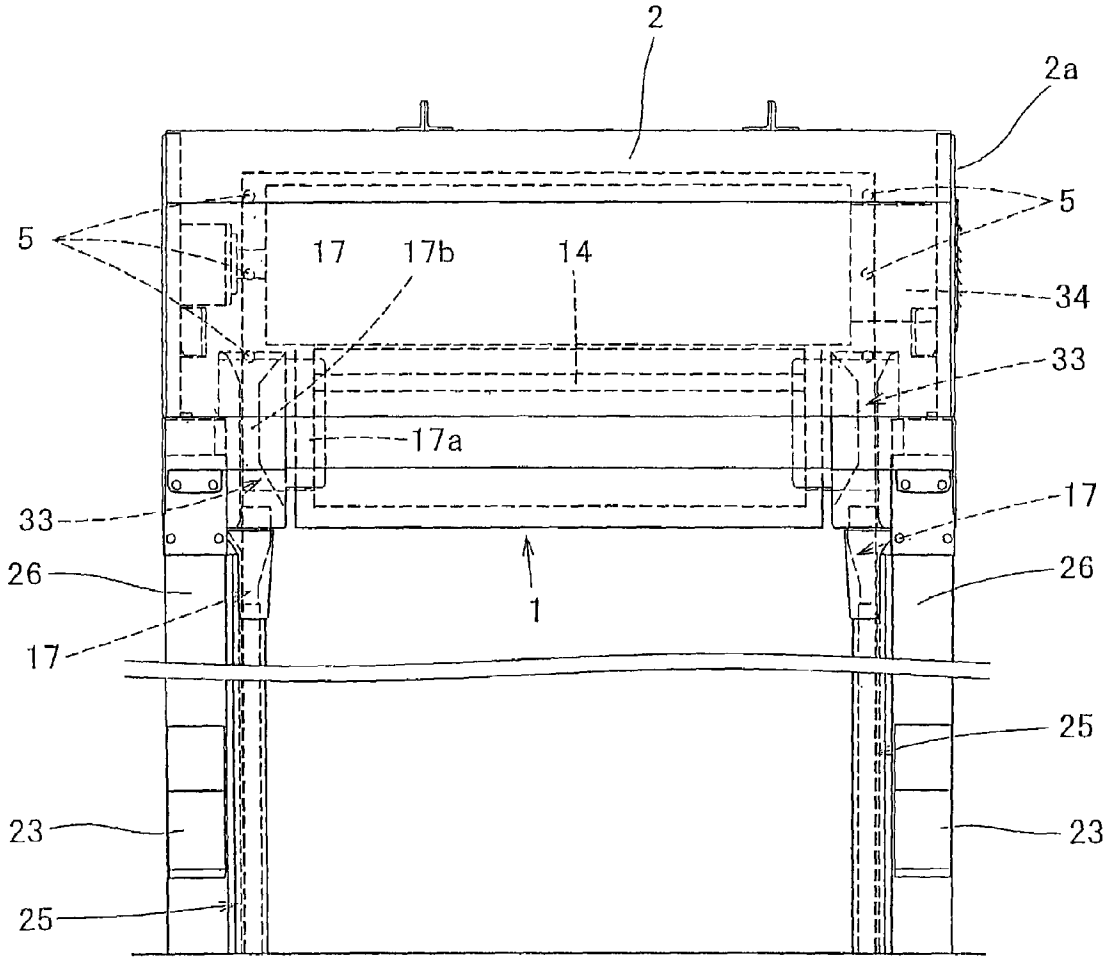
FIG. 17 is a front view showing the overall structure of a sheet shutter device according to a fourth embodiment.
Figure 18:
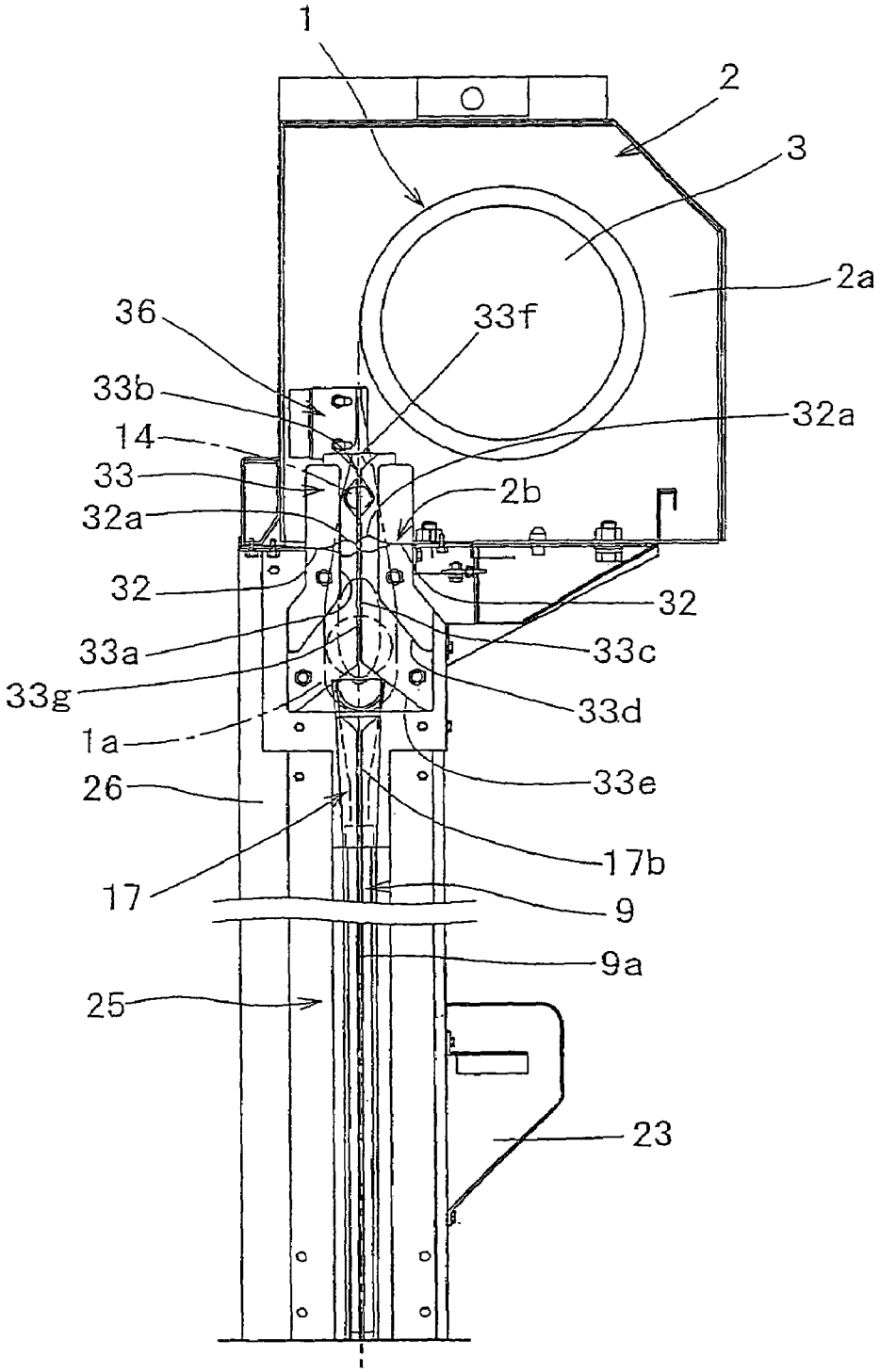
FIG. 18 is a side view showing the sheet shutter device according to the fourth embodiment.
Figure 19:
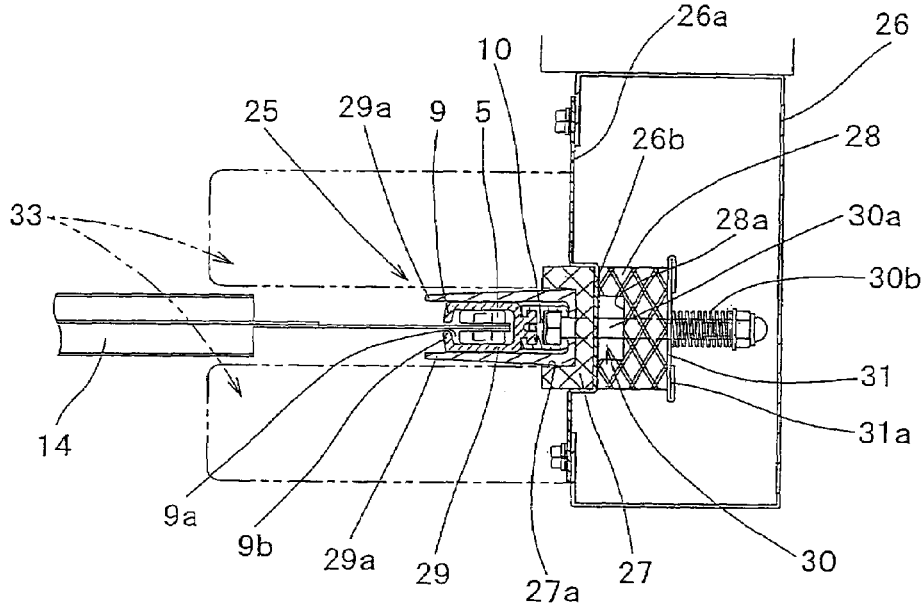
FIGS. 19(A) and 19(B) are planar cross-sectional views of the guide rail portion according to the fourth embodiment.
Figure 19:
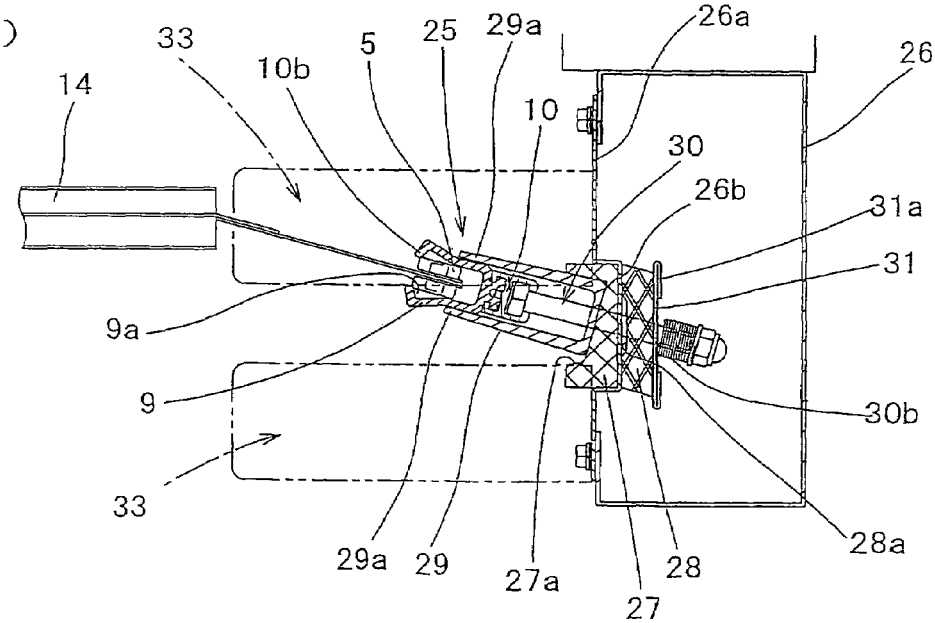
Figure 20:
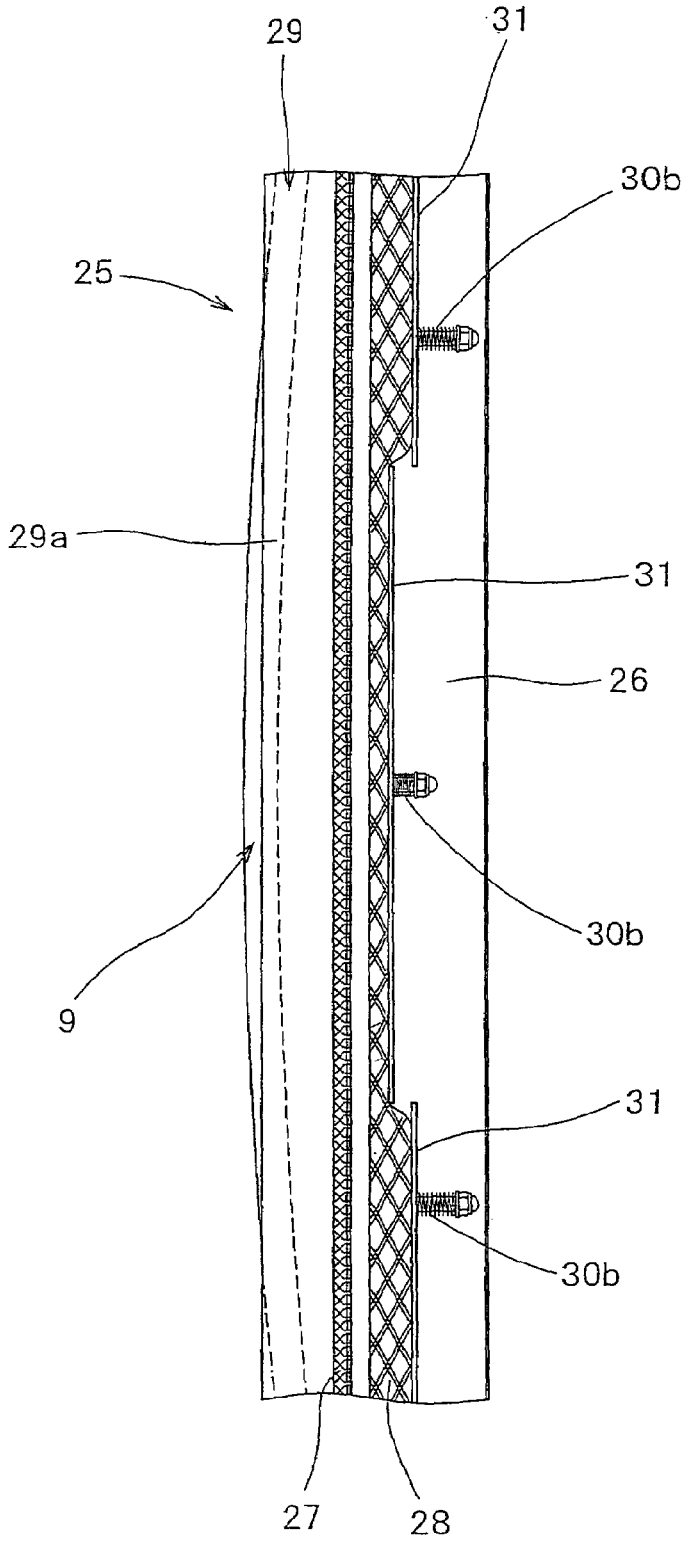
FIG. 20 is a partial front view showing the operation of the guide rail of the fourth embodiment.
Figure 21:
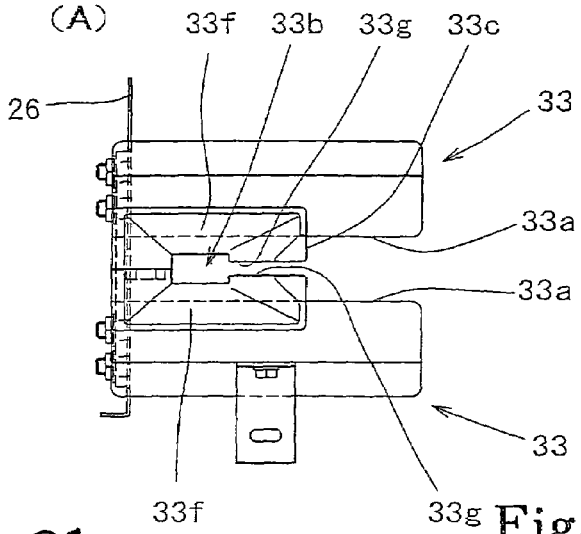
FIGS. 21(A), 21(B) and 21(C) are a plan view, front view and side view showing a fourth guide body of the fourth embodiment, respectively.
Figure 21:
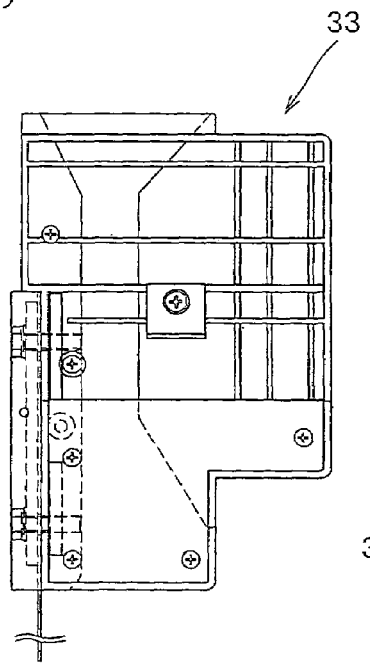
Figure 21:
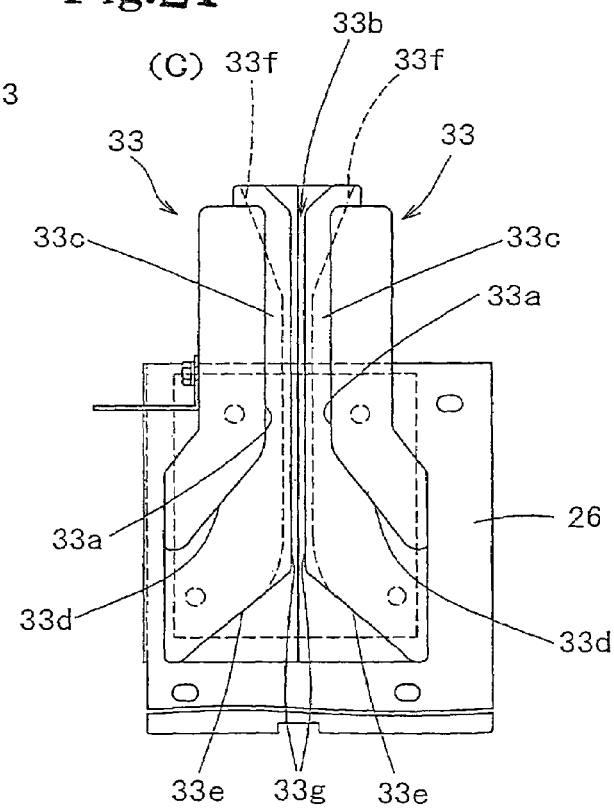

When a passing object (person, vehicle or the like) passes from the front side of the shutter curtain 1 at the left side of FIG. 12 (the right side of FIG. 11), the signal from the first starting sensor 21 located at the front side is input to the controller 20. Under this state, the controller 20 determines that there is a passing object moving from the front side of the sheet shutter device toward the rear side thereof, and sets to start the opening control. Under the opening control, the controller 20 outputs an opening operation command to the opening/closing device 19, and carries out the opening operation on the shutter curtain 1. In the process of the opening operation, the controller 20 determines whether there is an input of the detection signal from any one of the first and second detecting sensors 23, 24. If it is determined that there is no input signal from any one of the first and second detecting sensors 23, 24 and the sheet shutter device is set to the fully-opened posture under the state that no passing object passes over the shutter curtain 1, the controller 20 sets a first timer in which the standby time under the fully-opened posture is long (for example, 60 seconds). When there is no signal input from either one of the first and second detecting sensors 23, 24 while the first timer time elapses (until time-up), the control is shifted to the closing control in connection with the time-up of the first timer.

On the other hand, when it is determined that the detection signal from either one of the first and second detecting sensors 23, 24 is input to the controller 20 and also the shutter curtain 1 is set to the fully-opened posture after an object approaches and passes through the opening portion of the shutter curtain 1, the controller 20 sets a second timer in which the standby time under the fully-opened posture is short (for example, 2 seconds), and determines whether there is a signal input from the second starting sensor 22 disposed behind the shutter curtain 1 while the timer time elapses. When it is determined that there is a signal input from the second starting sensor 22 (other starting sensor) disposed behind the shutter curtain 1 during the second timer time and a passing object is separated from the vicinity of the shutter curtain 1 to the rear side, the second timer having the shorter timer time is set at the same time as the signal input from the second starting sensor 22, and the control is shifted to the closing control in connection with the time-up of the second timer. If there is no signal input from the other second starting sensor 22, the control is shifted to the closing control in connection with the time-up of the second timer.

In the process of the opening operation, when there is no signal input from either one of the first and second detecting sensors 23, 24 after the signal input from the first starting sensor 21, the first timer is set. If there is, subsequently, a signal input from either one of the first and second detecting sensors 23, 24 during the first timer time, it is determined that an object has passed through the opening portion of the sheet shutter device, and the controller 20 sets off (releases) the first timer and then sets the second timer having the shorter timer time. If there is a signal input from the other second starting sensor 22 during the second timer time, the second timer is reset in connection with the signal input, and the control is shifted to the closing control in connection with the time-up of the second timer. Furthermore, when there is no signal input from the second starting sensor 22 during the second timer time, the control is shifted to the closing control in connection with the time-up of the second timer.

When the control is shifted to the closing control, the controller 20 outputs a closing operation command, and also determines whether there is a signal input from either one of the first and second detecting sensors 23, 24. If there is no input signal from either one of the first and second detecting sensors 23, 24 and, thus, there is no obstruction in the closing route of the shutter curtain 1, the controller 20 outputs a closing operation command until the shutter curtain 1 is set to the fully-closed posture on the basis of the fact that there is no signal input from the first and the second starting sensors 21, 22. The state is restored to an initialization state under which input of the detection signals from the first and second starting sensors 21, 22 is in standby.

When there is the same signal input from the first starting sensor 21 as the previous control in the process of the closing operation, the controller 20 outputs an operation stop command to the opening/closing device 19, and also shifts the control to the opening control. The shutter curtain 1 is subjected to the opening operation in connection with the shift to the opening control.

When there is a signal input from the second starting sensor 22 in the process of the closing operation, the controller 20 determines that a vehicle which has passed is still in the vicinity of the sheet shutter device, and outputs an operation stop command to the opening/closing device 19. In addition, the controller 20 carries out the opening control after the input from the first and second detecting sensors 23, 24 so that the shutter curtain 1 is opened.

On the other hand, when there is a signal input from either one of the first and second detecting sensors 23, 24 in the process of the closing operation of the shutter curtain 1, the controller 20 determines that some obstruction, such as baggage or the like, exists in the closing route of the shutter curtain 1 and carries out obstruction detection control. The obstruction detection control outputs an operation stop command to the opening/closing device 19 to stop the closing operation of the shutter curtain 1 during a predetermined timer time (for example, 1 second), and then outputs an opening operation command to open the shutter curtain 1 until the shutter curtain 1 is set to a predetermined fully-opened posture.

After obstruction detection control is carried out as described above, the shutter curtain 1 is set to the fully-closed posture on the basis of a restoring operation, such as a manual operation or the like, thereby restoring the shutter curtain 1 to the initialization state. According to this embodiment, after a predetermined opening operation command is output, the opening posture is maintained during a predetermined timer time, and then a closing operation command is output to close the shutter curtain 1. On the basis of the setting of the shutter curtain 1 to the fully-closed posture, the initialization state, that is, the state that the detection signals from the first and second starting sensors 21, 22 are in standby is restored.

As described above, according to the control structure of the controller 20, in such a case where a vehicle temporarily stops in the vicinity of the shutter curtain 1, that is, when some detection is carried out by either one of the first and second starting sensors 21, 22, but no detection is carried out by the first and second detection sensors 23, 24, the standby time until the closing operation, started from the fully-opened posture is set to a long time, and thus an accident, etc., can be prevented. In such a case where a vehicle or the like passes over the opening portion and drives away therefrom, the closing operation is started after the shorter timer time elapses, so that the closing operation is quickly carried out. Therefore, the operability can be made excellent while maintaining sufficient safety.

Next, a fourth embodiment will be described with reference to FIGS. 17 to 21.

A guide rail 25 of the fourth embodiment is formed integrally in the vertical direction on one side piece portion 26*a* of a fixing bracket 26 corresponding to the fixing bracket 7 of the first embodiment. The one side piece portion 26*a* is provided with a recess portion 26*b* which is outwardly stepped and first and second buffer members 27, 28 are provided to the inside (opening portion side) and the outside of the recess portion 26*b* in the right-and-left direction. These buffer members 27, 28 comprise elongated members which extend in the vertical direction and are formed of elastically deformable material like the buffer member of the first embodiment. A recess portion 28*a* which is concave outwardly from the outer surface of the recess portion 26*b* of the fixing bracket 26 is formed in the second buffer member 28. The coming-off preventing load of the fitting piece 5 based on the elastic force of the second buffer member 28 can easily be adjusted by the size of the recess portion 28*a*.

The first buffer member 27 is engagedly fitted in the recess portion 26*a* of the fixing bracket at an outer half portion thereof. The outer portion of the support rail 29 which extends in the vertical direction and is formed of rigid material, such as a metal material, and has a U-shaped section engagedly fitted in a recess groove portion 27*a* formed in the first buffer member 27, and integrated by means such as adhesion or the like. Accordingly, the inner portion of the support rail 29 can be displaced (forward or backward swung) within a predetermined range in the front-and-rear directions on the basis of the elastic deformation of the first buffer 27.

Furthermore, as in the case of the first embodiment, a rail body 9, an auxiliary rail 10 and long bolts 30 are disposed in the support rail 29, and the arrangement structure of these elements is as described above. However, a coil spring 30*b* is wound around the shaft portion 30*a* of each long bolt 30 projecting into the rectangular tube of the fixing bracket 26. The urging force of the coil spring 30*b* is applied as the corning-off preventing load of the fitting piece 5 together with the elastic force of the second buffer member 28. Reference numeral 31 denotes a receiving plate member, and the receiving plate member 31 of this embodiment has a folded piece 31*a* at each side edge in the longitudinal direction to enhance the strength of the receiving plate to deformation.

Even in this case, the rail grove 9*a* of the rail body 9 is subjected to deformation regulation by the opposing piece portions 29*a* of the support rail 29. When the fitting piece 5 pulls the rail body 9 in the front-and-rear directions and in the right-and-left direction on the basis of the load imposed on the shutter curtain 1, the rail body 10 slides relative to the support rail 29 against the urging force of the coil spring 30*b* and the elastic force of the second buffer material 28 via the receiving plate member 31 (see FIG. 20). Also, the support rail 29 receives the elastic deformation of the first buffer member 27 and is swung and displaced in the front-and-rear directions (see FIG. 19(B)). Here, the recess portion 28*a* of the second buffer member 28 has the effect of enhancing the followability of the long bolt 30 which swings forward and backward together with the support rail 29. As in the case of the structure of the above-described embodiment, when the fitting piece 5 slides the rail body 9 relative to the support rail 29 and the rail body 9 comes off from, or out of, the support rail 29, the deformation regulation of the rail groove 9*a* of the rail body 9 by the opposing piece portions 29*a* of the support rail 29 is lost, and the rail groove 9*a* is deformed, so that the fitting piece 5 comes off.

As described above, in the guide rail 25 of this embodiment, it is permitted that the support rail 29 receives the elastic force of the first buffer member 27 and is swung in the front-and-rear directions, so that it is forward/backward swung by action of a load on the shutter curtain 1 in the front-and-rear directions. Therefore, when the rail body 9 comes off as a result of the load in the front-and-rear directions, the load acting locally on any one coming-off preventing piece portion 9*b* can be reduced, and further the support rail 29 is displaced in the load direction, so that the coming-off load can be easily adjusted.

Further, the shutter case 2 of this embodiment is equipped with a lintel sheet 32 which closes the case entrance/exit portion 2*b* and exhibits an effect as a smokescreen.

That is, the lintel sheet 32 is formed of material having the same flexibility as the sheet shutter 1, and comprises a pair of front and rear sheets. Furthermore, each lintel sheet 32 is folded at the tip end portion thereof to form a bag portion 32*a*. The base end portions of the bag portion 32*a* are provided at the case entrance/exit portion 2*b*, so that the sheet shutter curtain 1 passing via the case entrance/exit portion 2*b* is sandwiched by the base end portions from the front and rear sides. In the lintel sheet 32 thus structured, the bag portion 32*a* is deformed in the up-and-down direction and in the front-and-rear directions, thereby allowing the posture holding bar 14 to move upwardly and downwardly in connection with the opening/closing operation of the shutter curtain 1. Also, the bag portion 32*a* is designed to follow the bending of the shutter curtain 1 in the front-and-rear directions. Accordingly, attention is paid so that sealing performance is not lost.

A pair of fourth guide bodies 33 corresponding to the integrated assembly of the first and second guide bodies 15, 16 of the first embodiment are provided between the upper end portion of each of the right and left guide rails 25 and the winding drum 3. That is, the fourth guide bodies 33 are provided between the winding drum 3 and the upper end portion of the rail groove 9*a* of the pair of right and left guide rails 25. The posture holding bar 14, provided to the lowermost end portion of the shutter curtain 1, is guided (positionally oriented) to the opposing position to the rail groove 9*a* in the front-and-rear directions. The fourth guide bodies 33 may be formed of resin material having no flexibility (resin material having flexibility may be used), and fixed to the fixing bracket 26 as in the case of the first embodiment. Guide faces 33*a* are formed on the respective fourth guide bodies 33 so that they are located inside in the right-and-left direction so as to sandwich the end portion of the posture holding bar 14 from the front and rear sides in proximity with each other. These guide faces 33*a* are designed to be longer than the arrangement distance of the fitting pieces 5 of the shutter curtain 1, whereby the degree of freedom of the positional relationship between the posture holding bar 14 and the fitting piece 5 located at the lowermost end can be increased. A fitting piece guiding portion 33*b* is formed at the outside of the guide faces 33*a* in the right-and-left direction while the confronting interval thereof is narrowed so that the fitting piece 5 is guided so as to oppose the upper side of the support rail 29 constituting the guide rail 25 while being prevented from coming off. Step faces 33*c* opposing the right and left end faces of the posture holding bar 14 are formed between the guide faces 33*a* and the fitting piece guide portion 33*b*. Accordingly, the positional regulation (positioning) of the posture holding the bar 14 in the right-and-left direction is carried out.

Lower guideways 33*d*, 33*e* serving as inclined faces whose opposing interval is increased to the lower side are formed at the lower sides of the guide faces 33*a* and the fitting piece guiding portion 33*b* of the fourth guide bodies 33 so as to be continuous with the guide faces 33*a* and the fitting piece guiding portion 33*b*, respectively. Here, the maximum opposing interval between the lower side guideways 33*d* is set under the same conditions as the first embodiment. Furthermore, upper side guideways 33*f*, which are inclined to guide the fitting piece 5 so that the opposing interval therebetween is increased to the upper side, are formed at the upper portion of the fitting piece guide portion 33*b* from the front and rear and right and left faces, whereby the fitting piece 5 is smoothly moved from the winding drum 3 to the fourth guide bodies 33.

Curtain guide faces 33*g* extending along the curtain face of the shutter curtain 1 are formed at the inside of the fitting piece guiding portion 33*b* in the right-and-left direction so as to be long in the right-and-left direction, thereby guiding the right and left edge portions of the shutter curtain 1. Accordingly, the guide-movement of the shutter curtain 1 can be carried out on a broad plane, and it is considered that the winding posture of the shutter curtain 1 around the winding drum 3 is prevented from being disturbed (winding deformation is prevented) during the opening operation of the shutter curtain 1. Furthermore, it becomes possible to maintain the shutter curtain 1 without distortion which may be caused by an increase in thickness in the vicinity of the right and left end portion of the shutter curtain 1 due to the existence of the fitting portions 5 as compared with the intermediate portion during the closing operation of the shutter curtain 1, and the resistance between the shutter curtain 1 and the rail groove 9*a* can be reduced.

The third guide body 17 of the first embodiment is provided at the lower side of the fourth guide body 33, and the fitting piece 5 is reliably guided to the fitting piece guide portion 33*b*.

In the third and fourth guide bodies 17 and 33 of this embodiment, the fitting piece 5 at the lower end portion is fitted to the fitting piece guide portion 33*b* in conformity with the timing at which the posture holding bar 14 is guided to the guide face 33*a*, whereby the fitting piece 5 coming off from the guide rail 25 is automatically restored to be engagedly fitted in the guide rail 25.

Figure 22:
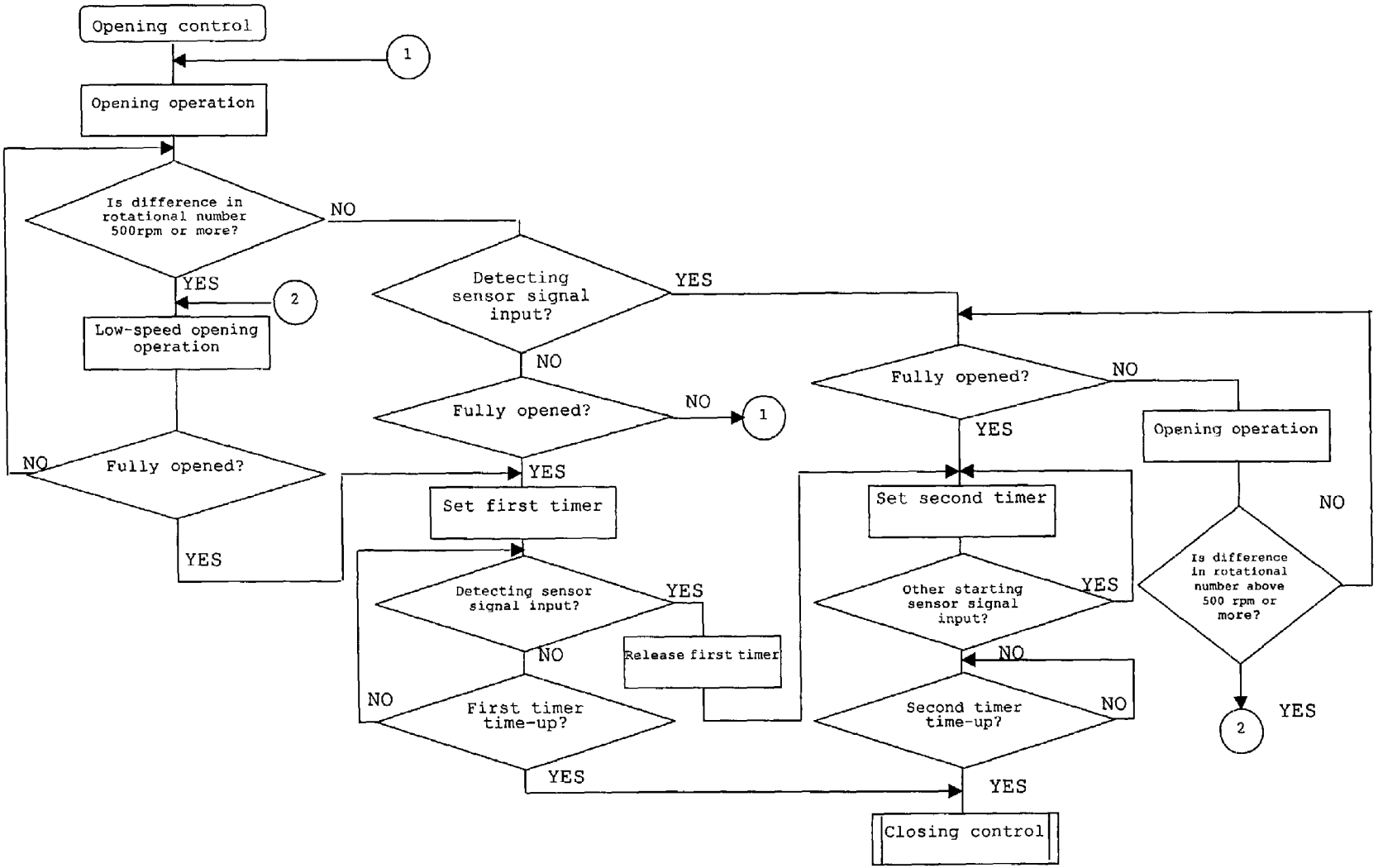
FIG. 22 is a flowchart showing the opening control in a controller of a fifth embodiment.

Next, a fifth embodiment will be described with reference to a flowchart of FIG. 22. The fifth embodiment is designed so that the opening/closing device 34 provided for the sheet shutter device having the basic structure of the fourth embodiment is provided with a rotation detecting sensor 35 for detecting the rotational number of the opening/closing device 34, and the operation control of the opening/closing device 34 is carried out on the basis of the control procedure of the controller (not shown) of the third embodiment.

When a detection value from the rotation detecting sensor 35 is less than a predetermined rotational number in the opening operation of the shutter curtain 1, the controller of this embodiment determines that a fitting piece 5 of the shutter curtain 1 has come off from the rail groove 9*a*. An automatic restoration and protection control for setting the opening speed of the opening/closing device 34 from a high speed to a low speed is carried out. Accordingly, when the fitting piece 5 of the shutter curtain 1 comes off from the rail groove 9*a*, the opening operation is carried out at a low speed, so that the automatic restoration of the fitting piece 5 to the rail groove 9*a* can be reliably performed by the third and fourth guide bodies 17, 33 and the posture holding bar 14.

In this case, when a detection value input from the rotation detecting sensor 35 during the opening operation of the shutter curtain 1 is smaller than the predetermined rotational number based on an another predetermined opening speed by a predetermined rotational number or more (in this embodiment the value is detected to be reduced by 500 revolutions per minute (rpm) with respect to the predetermined rotational number), the controller determines that a fitting piece 5 has come off from the rail groove 9*a*, and thus carries out the automatic restoring and protecting control. In the automatic restoring and protecting control, the controller outputs a low-speed opening operation command to an opening/closing device 34 so that the opening speed of the shutter curtain 1 is lower than a predetermined high speed. Accordingly, when the fitting piece 5 comes off from the rail groove 9*a* and the shutter curtain 1 which is free from the guide rail 25 is taken up, rip and tear of the shutter curtain 1 can be suppressed, so that the automatic restoring operation of the fitting piece 5 by the respective guide bodies 17, 33 and the posture holding bar 14 can be reliably performed and the shutter curtain 1 can be protected.

Next, the control procedure of the automatic restoring and protecting control will be described with reference to the flowchart of FIG. 22. In this case, there will also be described such a state that a passing object is about to pass from the front side of the shutter curtain 1 and thus a detection signal is input from the first starting sensor 23 to carry out the opening control. In this case, the controller determines whether the detection value of the rotational number of the opening/closing device 34 by the rotational detecting sensor 35 is lower than the rotational number in the normal opening operation by 500 revolutions per minute (rpm) or more. If it is determined that it is not lower by 500 rpm or more, the controller determines that the normal opening operation is being carried out, and an opening operation instruction based on a predetermined high opening speed is output. The control at this time is the same as the third embodiment, and the shutter curtain 1 is closed after a lapse of the first or second timer time in accordance with an input situation of the detection signal from the first and second detecting sensors 23, 24 and the detection signals from the first and second starting sensors 21, 22. Detailed description of the control is made for the third embodiment, and thus it is omitted from the following description.

On the other hand, when the detection value of the rotational number is lower by 500 revolutions per minute (rpm) or more, the controller carries out the automatic restoring and protecting control. In the automatic restoring and protecting control, a low-speed opening operation command is output to the opening/closing device 34 so that the opening speed of the shutter curtain 1 is set to a predetermined low speed (a speed at which rip and tear of the shutter curtain 1 can be prevented), thereby preventing the shutter curtain 1 from being damaged in advance. With respect to the opening operation based on detection of an obstruction, the controller may also carry out the automatic restoring and protecting control on the basis of the detection value from the rotational detecting sensor 35 when the rotational number is lower by 500 revolutions per minute (rpm) or more. In the automatic restoring and protecting control of the controller, the low-speed opening operation command may be output after an operation stop command is output in advance. In this case, the shutter curtain 1 is temporarily stopped and then the opening operation is carried out at a low speed. Therefore, the shutter curtain 1 can be further protected.

The detection of the coming-off of the shutter curtain 1 from the guide rail 4 (disengagement of at least one fitting piece 5 from the rail groove 9*a*) may be carried out on the basis of a variation amount of a current supply value to the opening/closing device 34. In this case, too, the disengagement can be detected on the basis of comparison with a predetermined current value with a simple structure. Accordingly, the return of the fitting piece 5 of the shutter curtain 1 to the rail groove 9*a* can be reliably performed with a simple and low-cost structure, and the sheet shutter device can be protected.

In the control procedure, the variation of the rotational number (disengagement state) is detected in the process for opening the shutter curtain. However, as a condition of disengagement of the fitting piece, because the following cases are assumed, that is, "after there is a signal input from the first and second detecting sensors 23, 24 in the process of the opening operation" or "after there is a signal input from the first and second detecting sensors 23, 24 during the closing operation", it may be structured that the rotational number of the opening/closing device 34 is detected in the above control process.

Figure 23:
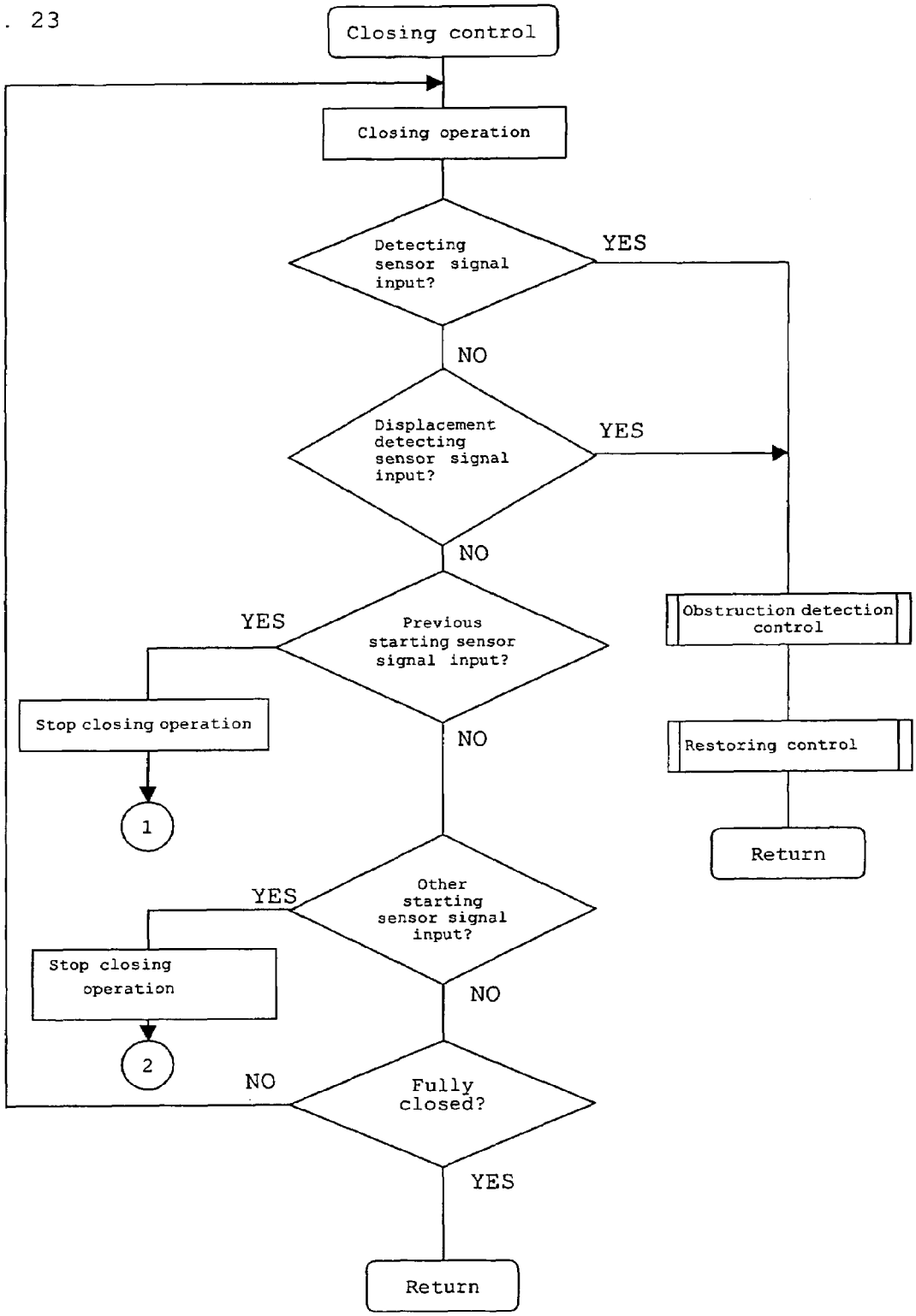
FIG. 23 is a flowchart showing the closing control in a controller of a sixth embodiment.

FIG. 23 is a flowchart showing a sixth embodiment. According to the sixth embodiment, in the sheet shutter device having the control structure described with respect to the third embodiment, a displacement detecting sensor 36 for detecting a shutter curtain 1 which is excessively wound off from the winding drum 3 and thus slackens (displaces) is provided at the right and left side plates 2*a* of the shutter case 2 when the shutter curtain 1 abuts against an obstruction, and the flowchart shows the control procedure of opening the shutter curtain 1 on the basis of obstruction detection indicating that the displacement detecting sensor 36 detects displacement of the shutter curtain 1.

In this embodiment, when there is an obstruction which cannot be detected by the first and second detecting sensors 23, 24, for example, the shutter curtain 1 abuts against a tip portion of a heavy vehicle and slackens, the displacement detecting sensor 36 detects that the shutter curtain 1 displaces so as to expand in the shutter case 2. The displacement detecting sensor 36 is structured by a photoelectric switch having a light emitter and a photodetector, and is disposed at each of the right and left side plates 2*a* in the shutter case 2 so that the optical axis of the light emitter is parallel to the shutter curtain 1 and is spaced from the outer peripheral surface of the shutter curtain 1 which is separated from the winding drum 3 and maintained hung while maintaining a predetermined interval from the shutter curtain 1. In this embodiment, the displacement detecting sensors 36 are disposed at the lower sides of the right and left side plates 2*a* in the vertical direction and just above the fourth guide bodies 33 (guide rails 4) so that the shutter curtain 1 displacing in the shutter case 2 can be detected over the entire area in the right-and-left width direction. The detection can be performed even when the shutter curtain 1 abuts against the obstruction at any place. In addition, the displacement detecting sensor 36 is structured by a photoelectric sensor, whereby the detection action can be carried out just when the optical axis is intercepted, and obstruction detection can be performed more quickly and reliably.

The controller (not shown) outputs the closing operation command in the closing control after the shutter device is opened on the basis of the first starting sensor 21, determines that there is no obstruction if there is no input detection signal from the first and second detecting sensors 23, 24 and the displacement detecting sensor 36 in the process of the closing operation of the shutter curtain 1, and carries out the closing operation on the basis of the no input detection signals from the first and second starting sensors 21, 22 until the shutter curtain 1 is set to the fully-closed posture. On the other hand, if there is a detection signal input from the first and second detecting sensors 23, 24 or from the displacement detecting sensor 36, the controller determines this as obstruction detection and carries out obstruction detection control. In obstruction detection control, the controller outputs the operation stop command to the opening/closing device during a predetermined time, and then outputs the opening operation command until the shutter curtain 1 is set to the preset opening posture.

If there is a detection signal input from the first starting sensor 21 in the process of the closing operation after the opening operation is carried out on the basis of the first starting sensor 21, the control is shifted to the opening control, and if there is a detection signal input from the other first starting sensor 22, the control is shifted to the opening control after the detection based on the first and second detecting sensors 23, 24.

Accordingly, in the sheet shutter device, even when obstruction detection cannot be performed by the first and second detecting sensors 23, 24, if obstruction detection based on the displacement detecting sensor 36 is carried out, obstruction detection control is executed, so that obstruction detection can be more reliably performed.

As described above, the sheet shutter device is effectively used as a shutter device provided to the opening portion of an architectural structure or the like, and particularly it is suitably used in a case where air conditioning atmosphere in a room can be maintained.

What is claimed is:

1. A sheet shutter device comprising:

fitting pieces that are provided at both a right-and-left side portions of a sheet-shaped shutter curtain so as to be spaced from one another at a predetermined distance in a vertical direction and made to run while engagedly fitted in right-and-left rail grooves of guide rails provided at both right-and-left side portions of an opening portion, thereby opening/closing the opening portion, wherein the rail grooves are designed so that the fitting pieces detach from the rail grooves under an excessive load imposed on the shutter curtain;

a posture holding bar that is provided horizontally to at least the lower end portion of the shutter curtain, such that a width of the posture holding bar is shorter than a width of the shutter curtain, so that the shutter curtain extends laterally between the fitting pieces and end portions of the posture holding bar, wherein shutter curtain portions that are fitted in the rail grooves of the guide rails are set to be right-and-left edge portions of the shutter curtain to which the posture holding bar does not extend;

a first guide body that is provided at a upper side of each of the right-and-left rail grooves and are provided for guiding the posture holding bar in a horizontal line between the right-and-left rails grooves; and a second guide body that is provided for guiding the right-and-left edge portions of the shutter curtain, to which the posture holding bar does not extend toward an upper direction in the rail groove, wherein when the fitting pieces detach from the rail grooves, fitting pieces that are positioned below the posture holding bar are guided by the second guide body so as to be moved upward in the rail grooves, based on that the posture holding bar is guided by the first guide body in a horizontal line between the right-and-left rail grooves in the process of opening/closing operation of the shutter curtain.

2. The sheet shutter device according to claim 1, wherein the second guide body is formed to be longer in a vertical direction than the predetermined distance of the fitting pieces.

3. The sheet shutter device according to claim 1, wherein a third guide body for guiding the fitting pieces toward each of the rail grooves is provided between the upper side of each of the rail grooves and the first guide body.

4. The sheet shutter device according to claim 3, wherein the third guide body is provided with a freely deformable piece which can be deformed in a front-and-rear direction corresponding to a direction perpendicular to a curtain face.

5. The sheet shutter device according to claim 1, wherein the first guide body has a pair of guide pieces and each of the guide pieces has a top and bottom guide face that is continuous with a guideway; and wherein each guideway has an inclined-shape to create a gap, and to provide for guiding of the posture holding bar to a horizontal position between the right-and-left rail grooves.

6. The sheet shutter device according to claim 3, wherein a freely deformable piece of the third guide body is formed so as to be located in the gap between the guideways that are continuous with the bottom guide face of each of the guide pieces.

7. The sheet shutter device according to claim 1, wherein the first and second guide bodies are integrally formed with each other.

8. The sheet shutter device according to claim 5, wherein a step face for regulating the horizontal position in a right-and-left direction of the posture holding bar is formed between the guide pieces of the first guide body and a fitting piece guide portion which is formed in the second guide body and guides the fitting pieces toward the rail groove.

9. The sheet shutter device according to claim 8, wherein a curtain guide face for guiding both right and left side edge portions of the shutter curtain is formed in the fitting piece guide portion of the second guide body.

10. The sheet shutter device according to claim 1, wherein the guide rail comprises a support rail fixed to each of both sides of the opening portion, a rail body which is engaged with the fitting pieces and supported so as to be freely displaced to an inside of the opening portion with respect to the support rail, and an urging means for urging outwardly the rail body displaced to the inside of the opening portion in connection with a load imposed on the shutter curtain, the urging means comprises an elongated elastic member disposed along an outer surface of the support rail, an elongated receiving plate member applied to an outer surface of the elastic member and a joint member provided between the rail body and the receiving plate member so as not to come off, and an elastic deforming force of the elastic member acts on the rail body via the receiving plate member.

11. The sheet shutter device according to claim 2, wherein a third guide body for guiding the fitting pieces toward each of the rail grooves is provided between the upper side of each of the rail grooves and the first guide body.

12. The sheet shutter device according to claim 11, wherein the third guide body is provided with a freely deformable piece which can be deformed in the front-and-rear direction corresponding to a direction perpendicular to the curtain face.

13. The sheet shutter device according to claim 2, wherein the first guide body has the pair of guide pieces and each of the guide pieces has the top and bottom guide face that is continuous with the guideway;

wherein each guideway has the inclined-shape to create the gap, and to provide for guiding of the posture holding bar to the horizontal position between the right-and-left rail grooves.

14. The sheet shutter device according to claim 4, wherein the first guide body has the pair of guide pieces and each of the guide pieces has the top and bottom guide face that is continuous with the guideway;

wherein each guideway has the inclined-shape to create the gap, and to provide for guiding of the posture holding bar to the horizontal position between the right-and-left rail grooves.

15. The sheet shutter device according to claim 4, wherein the freely deformable piece of the third guide body is formed so as to be located in the gap between the guideways that are continuous with the bottom face of each of the guide pieces.

16. The sheet shutter device according to claim 4, wherein the first and second guide bodies are integrally formed with each other.

17. The sheet shutter device according to claim 15, wherein the first and second guide bodies are integrally formed with each other.

18. The sheet shutter device according to claim 4, wherein the guide rail comprises a support rail fixed to each of both sides of the opening portion, a rail body which is engaged with the fitting pieces and supported so as to be freely displaced to the inside of an opening portion with respect to the support rail, and an urging means for urging outwardly the rail body displaced to the inside of the opening portion in connection with a load imposed on the shutter curtain, the urging means comprises an elongated elastic member disposed along an outer surface of the support rail, an elongated receiving plate member applied to an outer surface of the elastic member and a joint member provided between the rail body and the receiving plate member so as not to come off, and an elastic deforming force of the elastic member acts on the rail body via the receiving plate member.

19. The sheet shutter device according to claim 9, wherein the guide rail comprises a support rail fixed to each of both sides of the opening portion, a rail body which is engaged with the fitting pieces and supported so as to be freely displaced to the inside of an opening portion with respect to the support rail, and an urging means for urging outwardly the rail body displaced to the inside of the opening portion in connection with a load imposed on the shutter curtain, the urging means comprises an elongated elastic member disposed along an outer surface of the support rail, an elongated receiving plate member applied to an outer surface of the elastic member and a joint member provided between the rail body and the receiving plate member so as not to come off, and an elastic deforming force of the elastic member acts on the rail body via the receiving plate member.

20. The sheet shutter device according to claim 16, wherein the guide rail comprises a support rail fixed to each of both sides of the opening portion, a rail body which is engaged with the fitting pieces and supported so as to be freely displaced to the inside of an opening portion with respect to the support rail, and an urging means for urging outwardly the rail body displaced to the inside of the opening portion in connection with a load imposed on the shutter curtain, the urging means comprises an elongated elastic member disposed along an outer surface of the support rail, an elongated receiving plate member applied to an outer surface of the elastic member and a joint member provided between the rail body and the receiving plate member so as not to come off, and an elastic deforming force of the elastic member acts on the rail body via the receiving plate member.

* * * * *